US007538283B2

(12) United States Patent
Muromachi

(10) Patent No.: US 7,538,283 B2
(45) Date of Patent: May 26, 2009

(54) SWITCH DEVICE AND ASSEMBLY METHOD THEREOF

(75) Inventor: Tetsushi Muromachi, Aichi-ken (JP)

(73) Assignee: Kabushiki Kaisha Tokai-Rika-Denki-Seisakusho, Aichi-ken (JP)

( * ) Notice: Subject to any disclaimer, the term of this patent is extended or adjusted under 35 U.S.C. 154(b) by 0 days.

(21) Appl. No.: 11/834,293

(22) Filed: Aug. 6, 2007

(65) Prior Publication Data

US 2008/0035465 A1 Feb. 14, 2008

(30) Foreign Application Priority Data

Aug. 10, 2006 (JP) ..... 2006-217713

(51) Int. Cl.
*H01H 3/16* (2006.01)

(52) U.S. Cl. ..... 200/61.58 B; 24/633

(58) Field of Classification Search ..... 200/61.13, 200/61.14, 61.18, 61.19, 252, 257–260; 29/622; 24/633, 268, 634, 637, 640, 664
See application file for complete search history.

(56) References Cited

U.S. PATENT DOCUMENTS 6,907,646 B2 6/2005 Lee et al.
7,360,288 B2 * 4/2008 Takao ..... 24/633
2007/0271746 A1 * 11/2007 Midorikawa et al. ..... 24/633

FOREIGN PATENT DOCUMENTS

JP 2005-190906 A 7/2005

* cited by examiner

*Primary Examiner*—Edwin A. Leon
(74) *Attorney, Agent, or Firm*—Roberts Mlotkowski Safran & Cole, P.C.; Thomas W. Cole

(57) ABSTRACT

A switch device, comprising: a switch base plate that includes a sliding surface on one side thereof, a sliding member that is provided with a first claw portion and a second claw portion, the sliding member being latched by the first and second claw portions, and the sliding member also being supported by the switch base plate so as to be slidable in a sliding direction; a contact member that is disposed in a position opposing a sliding surface of the sliding member, the contact member being deformed by bending by a pressing force from the sliding surface, and the contact member is pressed against the sliding surface by a restorative force from the bending deformation; an extended portion that is formed at a leading end portion of the switch base plate; and a cut-out portion that is formed at the leading end portion of the switch base plate.

8 Claims, 12 Drawing Sheets

SWITCH DEVICE AND ASSEMBLY METHOD THEREOF

CROSS-REFERENCE TO RELATED APPLICATION

This application claims priority under 35 U.S.C. 119 from Japanese Patent Application No. 2006-217713, the disclosure of which is incorporated by reference herein.

BACKGROUND

1. Technical Field

The present invention relates to a switch device provided with a sliding member that is supported by a switch base plate so that it is able to slide along a predetermined sliding direction, and in which switching operation is carried out according to the position of the sliding member. The present invention also relates to an assembly method of the same.

2. Related Art

Recently, various vehicle seats such as car seats are fitted with seat belt devices for protecting the occupants thereof in the event of an emergency such as an impact. Such types of seat belt devices are provided with a buckle and a tongue plate for latching to this buckle. In such seat belt devices, the seatbelt is fastened by the tongue plate being inserted into the buckle, and by latching the tongue plate with a latch mechanism that has been built into the buckle. Furthermore, the seatbelt is unfastened by releasing the latching state by means of the latching mechanism and removing the tongue plate from the buckle. In such a seat belt device, there is normally a buckle switch provided in the buckle, which detects the latching state with respect to the tongue plate, and, for example, a control portion of the vehicle determines the fastening status of the seat belt using a contact signal output from the buckle switch.

The buckle switch used in the above described seat belt devices is known and has been described in Japanese Patent Application (JP-A) No. 2005-190906. The buckle switch described in JP-A No. 2005-190906 is provided with a base plate (switch base plate) that has a predetermined conductive pattern formed on one of the faces thereof (the sliding surface), and a sliding member that: has claw portions formed on each of the end portions in the width direction thereof, has a slider contact disposed on an opposing face of the switch base plate, the opposing face facing the sliding surface; latches respectively each of the end portions in the width direction of the switch base plate by the pair of claw portions; and thereby is supported by the switch base plate so as to be able to slide in the longitudinal direction of the switch base plate.

Here, the slider contact is formed as a long thin beam shape, and is supported by the sliding member in a cantilevered state. The slider contact is provided with contact portions at the leading end side thereof, the contact portions being curved substantially in a V-shape so as to project out toward the sliding surface side, and these contact portions are pressed against the sliding surface (against the conductive pattern).

In a switch device like the one described in JP-A No. 2005-190906, when the sliding member is being assembled to the switch base plate, after the positioning of the opposing face of the sliding member above the extending face of the sliding surface of the switch base plate while keeping the sliding member to the outside in the longitudinal direction of the switch base plate (sliding direction), the sliding member is slid along the sliding direction relatively toward the switch base plate side, and the switch base plate is inserted between the pair of claw portions of the sliding member. By so doing, both end portions in the width direction of the switch base plate are latched by the pair of claw portions of the sliding member, and the sliding member is supported by the switch base plate so that it is able to slide as well as the sliding member being prevented from separating away from over the switch base plate.

However, when a sliding member is assembled to a switch base plate with such a method, when the switch base plate is being inserted between the pair of claw portions of the sliding member, unless the slider contact, which has been disposed to the sliding member, is pressed and bent by the end portion at the insertion side of the switch base plate (the leading end portion), the switch base plate cannot be inserted between the pair of claw portions without the slider contact getting in the way. However, since the slider contact is formed of a thin metallic plate, there is sometimes deformation (plastic deformation) of the slider contact that originates from the vicinity of the contact portions due to a pressing force from the switch base plate when the leading end portion of the switch base plate has made contact with the contact portions of the slider contact.

Such a problem as described above may be reliably avoided with high probability by adept manipulation by an operative when carrying out assembly of the switch device, however, variation in the dimensional precision of the slider contact and the influence of the level of the operation skill cause such a problem as described above cannot be completely avoided. This makes the checking of the switch devices complicated and results in a decrease in the yield of the switch devices.

SUMMARY

The present invention has been made in consideration of the above circumstances and provides a switch device that has a sliding member that may be easily assembled to a switch base plate and may effectively prevent damage to the contact member that has been disposed to the sliding member during assembly. The present invention also provides an assembly method of the same.

In order to solve the above problems a first aspect of the present invention provides a switch device, including a switch base plate that includes a sliding surface on one side thereof, and has conducting patterns of a predetermined shape provided on the sliding surface; a sliding member that is provided with a first claw portion and a second claw portion, the sliding member being latched at one end portion and the other end portion in a width direction of the switch base plate by the first claw portion and the second claw portion, respectively, and the sliding member also being supported by the switch base plate so as to be slidable in a sliding direction that is orthogonal to the width direction of the switch base plate; a contact member that is formed from a flexible conductive material and is disposed in a position opposing a sliding surface of the sliding member, the contact member being deformed by bending by a pressing force from the sliding surface in a state in which the switch base plate is latched by the first claw portion and the second claw portion, and the contact member is pressed against the sliding surface by a restorative force from the bending deformation; an extended portion that is formed at a leading end portion of the switch base plate, where one end side in a width direction of the leading end portion of the switch base plate is caused to partially extend further in the sliding direction than the other end side in the width direction, the extended portion also configured to be latched by the first claw portion; and a cut-out portion that is formed at the leading end portion of the switch base plate and causes the leading end portion of the switch base plate to be in a state of non contact with the second claw portion when the extended portion is in a state of being latched by the first claw portion.

In the switch device of the first aspect of the present invention, the extended portion that is formed at the leading end portion of the switch base plate, wherein one end side in the width direction of the leading end portion of the switch base plate is caused to extend partly further in the sliding direction than the other end side in the width direction, and the extended portion is also caused to be able to be latched by the first claw portion. Therefore, when the switch base plate is latched by the first and second claw portions of the sliding member, the switch base plate may be supported by the sliding member so as to be able to swing with the one of the first claw portions at the insertion direction side as the center, by latching the extended portion with the one of the first claw portions Furthermore, in the switch device of the first aspect of the present invention, in a state like that above in which the extended portion is latched by one of the first claw portions, by the cut-out portion that has been formed on the leading end portion of the switch base plate making the leading end portion of the switch base plate be in a non contact state with the second claw portions, when the extended portion of the switch base plate is only latched by one of the first claw portions, the switch base plate is able to be swung, with one of the first claw portion at the center, from a position where the sliding surface is separated from the contact member to a position where the contact member is deformed by the sliding surface with a predetermined amount of bending, without contacting with the second claw portions.

Therefore, in the switch device of the first aspect, while the leading end portion of the switch base plate is in a state of non contact with the second claw portion due to the cut-out portion, after swinging, with one of the first claw portions at the center, the switch base plate from a position in which the sliding surface is separated from the contact member, to a position in which the contact member is deformed by the sliding surface with a predetermined amount of bending, if the switch base plate is moved relative to the sliding member toward the ejection direction, and the base end side of the extended portion and the cut-out portion of the switch base plate are inserted between the first claw portions and the second claw portions, then both end portions in the width direction of the switch base plate are respectively latched by the first claw portions and the second claw portions, and the sliding member can be supported by the switch base plate so as to be slidable.

Here, after the contact member has been put into the state of having been pressed and deformed by bending by the sliding surface of the switch base plate, the base end side of the extended portion and the cut-out portion of the switch base plate are able to be inserted between the first claw portion and the second claw portion. Therefore, when the switch base plate is being inserted between the first claw portion and the second claw portion, there is no pressing force acting from the switch base plate on the contact member along the sliding direction, and plastic deformation of the contact member, due to such a pressing force along the sliding direction, may be prevented.

As a result of this, in the switch device of the first aspect, when assembling the sliding member to the switch base plate, operations that require a skilled operator become unnecessary, and also, when inserting the switch base plate between the first claw portion and the second claw portion, since plastic deformation of the contact member due to the pressing force from the switch base plate is eliminated, the sliding member may be assembled simply to the switch base plate, and damage to the contact member disposed on the sliding member during assembly is effectively prevented.

A switch device of a second aspect of the present invention is the switch device of the first aspect, further provided with: a body casing; a base plate base that is connected and fixed to a base end side of the switch base plate; a fitting insertion hole that is provided at the body casing, into which the extended portion is insertable along the sliding direction; and a latching portion that is provided at the body casing and that, when the extended portion is in a state of being fitted into the fitting insertion hole, latches the base plate base and fixes the base plate base and the switch base plate to the body casing.

In the switch device of the second aspect as above, a fitting insertion hole is provided to the body casing so that the extended portion is able to be fitted therein by insertion along the sliding direction and also when the extended portion is in the state of having been fitted into the fitting insertion hole, by the latching portion for latching the base plate base being provided to the body casing, after the extended portion of the switch base plate has been fitted into the fitting insertion hole of the body casing, latching the base plate base to the extended portion of the body casing, the base plate base and the switch base plate may be fixed to the body casing, and therefore fixing the base plate base and the switch base plate to the body casing may be made a simple operation.

Furthermore, the switch device assembly method of a third aspect of the present invention is a switch device assembly method for assembling a switch device of the first aspect or of the second aspect. The method includes a first process of latching the extended portion with the first claw portion; a second process of, while the leading end portion of the switch base plate is in a state of non contact with the second claw portion due to the cut-out portion, swinging the switch base plate, with the first claw portion as a center, from a position in which the switch base plate is separated from the contact member to a position in which the contact member is deformed by bending due to the sliding surface; and a third process of sliding the switch base plate along the sliding direction relative to the sliding member, and latching the base end side of the extended portion and the cut-out portion of the switch base plate with the first claw portion and second claw portion.

In the above switch device assembly method of the third aspect, first, in the first process, by latching the extended portion of the switch base plate with the first claw portion, the switch base plate may be supported so as to be able to be swung with the first claw portion as a center.

Next, in the second process, while the leading end portion of the switch base plate is in a state of non contact with the second claw portion due to the cut-out portion, by swinging the switch base plate with the first claw portion as a center from a position in which the switch base plate is separated from the contact member to a position in which the contact member is deformed by bending due to the sliding surface, there is no pressing force acting on the contact member from the switch base plate along the sliding direction, and so the contact member is able to be deformed by bending by the required amount.

Finally, in the third process, the switch base plate is slid relative to the sliding member along the sliding direction, and the base end side of the extended portion and the cut-out portion of the switch base plate are latched with the first claw portion and second claw portion, and the sliding member may be supported by the switch base plate so as to be able to slide.

Here, after the contact member has been put into the state of being pressed and deformed by bending by the sliding surface of the switch base plate, the base end side of the extended portion and the cut-out portion of the switch base plate is able to be inserted between the first claw portion and the second claw portion. Therefore, when the switch base plate is being inserted between the first claw portion and the second claw portion, there is no pressing force acting from the switch base plate on the contact member along the sliding direction, and plastic deformation of the contact member, due to such a pressing force along the sliding direction, may be prevented.

As a result of this, by the switch device assembly method of the third aspect, when assembling the sliding member to the switch base plate, operations that require a skilled operator may be made unnecessary, and also, when inserting the switch base plate between the first claw portion and the second claw portion, since plastic deformation of the contact member due to the pressing force from the switch base plate is eliminated, the sliding member may be assembled simply to the switch base plate, and damage to the contact member disposed on the sliding member during assembly may be effectively prevented.

A switch device assembly method of a fourth aspect is the switch device assembly method of the third aspect in which, after the third process has been completed, there is also a fourth process of inserting the extended portion into the fitting insertion hole along the sliding direction after the third process is completed; and a fifth process of fixing the base plate base and the switch base plate to the body casing by latching the base plate base to the latching portion in a state in which the extended portion is fitted into the fitting insertion hole.

A switch device of a fifth aspect of the present invention is the switch device of the second aspect, further provided with: a latching tab that is formed at one end face in the thickness direction of the base plate base, and a latching claw portion that is disposed on the latching portion with a cross-section having a sloping shape, the base plate base and the switch base plate being fixed to the body casing by latching between the latching tab and the latching claw portion.

A switch device of a sixth aspect of the present invention is the switch device of the second aspect, further provided with: a base abutment portion that is provided at the body casing so as to face the latching portion, and that abuts the other end face in the thickness direction of the base plate base.

By the above switch device assembly method of the fourth aspect, after the extended portion has been inserted into the fitting insertion hole of the body casing along the sliding direction in the fourth process, the base plate base and the switch base plate may be fixed in a simple manner to the body casing by the base plate base, which is connected and fixed to the base end portion of the switch base plate, being latched to the latching portion of the body casing.

As has been explained above, by the switch device and the switch device assembly method according to the present invention, a sliding member may be easily assembled to a switch base plate, and damage to the contact member that has been disposed to the sliding member during assembly may be effectively prevented.

BRIEF DESCRIPTION OF THE DRAWINGS

An exemplary embodiment of the present invention will be described in detail based on the following figures, wherein.

DETAILED DESCRIPTION

Explanation will now be given, with reference to the drawings, of a buckle switch according to an exemplary embodiment of the present invention and a buckle device to which such a buckle switch is applied.

CONFIGURATION OF THE EXEMPLARY EMBODIMENT

Figure 1:
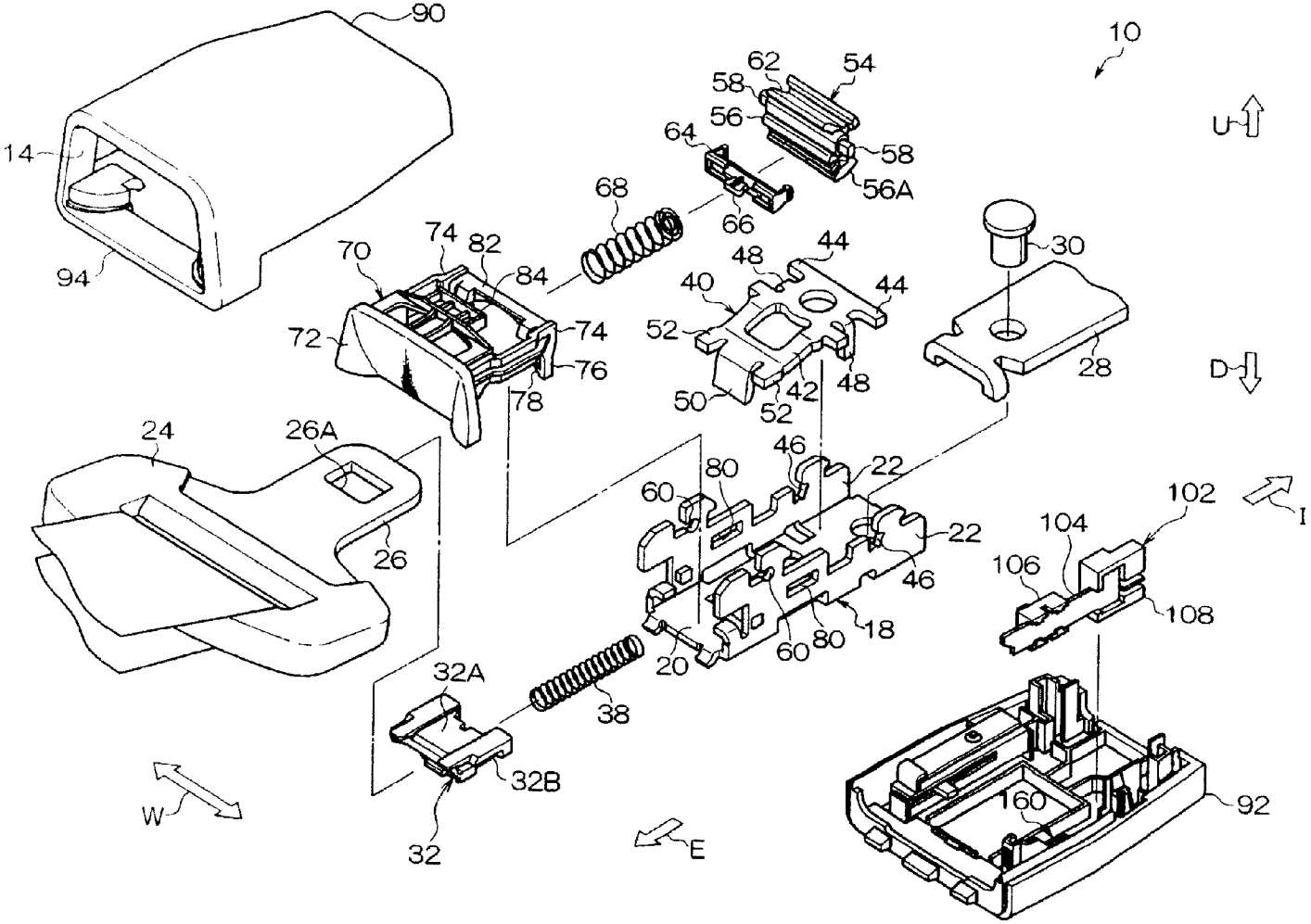
FIG. 1 is an exploded perspective diagram showing the overall configuration of a buckle device to which a buckle switch according to an exemplary embodiment of the present invention has been applied.

FIG. 1 shows a configuration of a buckle device 10 according to an exemplary embodiment of the present invention through an exploded perspective diagram. Furthermore, in FIG. 2 and FIG. 3, the configuration of the buckle device 10 is shown in cross-section.

Figure 2:
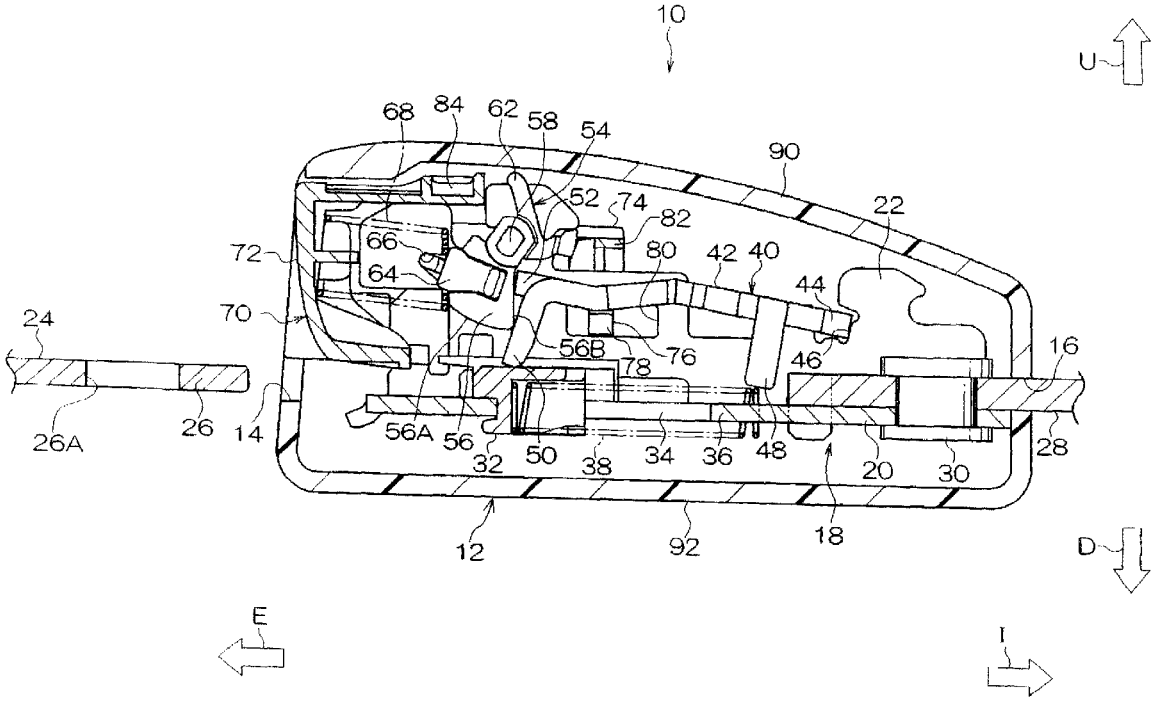
FIG. 2 is a cross-section of the overall configuration of the buckle device shown in FIG. 1, and shows an unfastened state thereof.

As shown in FIG. 2, the buckle device 10 is provided with a body casing 12 as an outer shell portion of the buckle device 10. The body casing 12 is formed overall into a tubular box shape, having openings at both ends in the longitudinal direction thereof, and, as shown in FIG. 1, the body casing 12 is a 2 part structure made up from an upper casing 90 and a lower casing 92. There is an angular tubular shaped tubular portion 94 formed integrally at one end slide in the longitudinal direction of the upper casing 90 (the side in the direction of arrow E), and there is a tongue insertion slot 14 opened at one end face of the tubular portion 94. An insertion plate portion 26 of a tongue plate 24 is able to be inserted into, and ejected from, the interior of the body casing 12 through the tongue insertion slot 14. Here, the arrows shown in FIG. 1 that have been allocated references I and E indicate, respectively, the insertion direction and the ejection direction of the tongue plate 24 into/from the body casing 12.

As shown in FIG. 2, when the lower casing 92 is in the assembled state to the upper casing 90, there is an anchor insertion slot 16 formed as a narrow slot shape along the width direction of the buckle device 10 (direction of arrow W) at the other end face of the body casing 12 in the ejection direction. A buckle body 18 made from a metal plate is accommodated in the interior of the body casing 12. The buckle body 18 is provided with a bottom plate portion 20, which is formed as a flat plate shape that is elongated along the longitudinal direction of the body casing 12, and a pair of side wall portions 22, which extend integrally from both end portions in the width direction of the bottom plate portion 20 toward the top end side (in the direction of arrow U) along the thickness direction of the device. The buckle body 18 is formed thereby into substantially a U-shape in a cross-section taken along a direction orthogonal to the axial direction, with the opening thereof being toward the top end side. The buckle body 18 is structured such that the insertion plate portion 26 of the tongue plate 24 inserted through the tongue insertion slot 14 of the body casing 12 is inserted between the pair of side wall portions 22 from one end side in the longitudinal direction of the bottom plate portion 20.

Also, at the other end side in the longitudinal direction of the bottom plate portion 20, the leading end portion of an anchor plate 28 that has been inserted from the anchor insertion slot 16 of the body casing 12 is superimposed, and the bottom plate portion 20 and the anchor plate 28 are connected together by a rivet 30 that passes through the two elements. The base end side of the anchor plate 28 is fixed to a vehicle body at the side of a vehicle seat (both omitted from the drawing), and by doing so the buckle device 10 is fixed to the vehicle.

In the buckle body 18, there is a plate shaped ejector 32 disposed between the pair of side wall portions 22. The lower end portion of the ejector 32 engages with a substantially rectangular through hole 34 that has been formed in the bottom plate portion 20. The through hole 34 is formed so as to be long in the longitudinal direction of the bottom plate portion 20, and the ejector 32 is able to slide along the through hole 34 within a predetermined range in the longitudinal direction of the bottom plate portion 20. Specifically, the ejector 32 is able to slide in the insertion direction and the ejection direction between an ejection position (see FIG. 2 and FIG. 5) and an insertion position (see FIG. 3 and FIG. 6).

There is an engaging protrusion 36 formed at the internal periphery at the other end side in the longitudinal direction of the through hole 34 (the side in the direction of arrow I), and the engaging protrusion 36 is formed so as to protrude toward the ejection direction side. One end of an ejector spring 38 which is as a compression coil spring is latched to the engaging protrusion 36. The other end of the ejector spring 38 is latched to the ejector 32, and the ejector 32 is constantly biased by the biasing force of the ejector spring 38 toward the ejection direction side. The ejector 32 is configured such that when it is pressed by the insertion plate portion 26 of the tongue plate 24 that is inserted between the pair of side wall portions 22, the ejector 32 slides toward the insertion direction side of the bottom plate portion 20 against the biasing force of the ejector spring 38 (see the state shown in FIG. 3).

As may be seen from FIG. 1, there is an engaging recessed portion 32B formed at the side end face of one side in the width direction of the ejector 32 (the right side in FIG. 1). The engaging recessed portion 32B is disposed at an intermediate portion in the insertion direction on the side end face of the ejector 32, and a cross section of the engaging recessed portion 32B when viewed from above is shaped so as to be substantially a rectangle with the longitudinal direction in the insertion direction. The leading end side of an engaging protrusion 146 of a buckle switch 100, described later, is inserted into the engaging recessed portion 32B.

As shown in FIG. 1 and FIG. 2, in the buckle device 10, there is a lock plate 40 disposed at the top side of the ejector 32. The lock plate 40 is provided with a base portion 42 that is formed as a long plate shape along the longitudinal direction of the bottom plate portion 20. There is a pair of support portions 44 formed protruding out to each side in the width direction from the base end portion of the base portion 42 (the end portion at the insertion direction side). The pair of support portions 44 intrude into respective support holes 46 that have been formed in the pair of side wall portions 22 of the buckle body 18, and the lock plate 40 is supported by the pair of side wall portions 22 such that it is able to swing by a predetermined angle around the pair of support portions 44 (the support holes 46).

Furthermore, at the base end side of the base portion 42, there are a pair of arm portions 48 protruding from both ends in the width direction out along the thickness direction of the device (to the arrow D direction side) toward the lower end side. The pair of arm portions 48 are formed so that the leading end sides thereof are positioned in the sliding path of the ejector 32, and when the ejector 32 slides toward the other end of the bottom plate portion 20 (the arrow I direction side), the pair of arm portions 48 are pressed toward the other end side of the bottom plate portion 20 by the end portion of the ejector 32, and the base portion 42 (lock plate 40) swings toward the bottom plate portion 20 side (to the arrow D direction side, into the engagement position) about the pair of support portions 44 as the centre.

There is an engaging tab 50 that extends out from the leading end portion of the base portion 42 (the end portion at the arrow E direction side), the engaging tab 50 extending along the thickness direction of the base portion 42 toward the bottom plate portion 20 side. The engaging tab 50 is formed so that the leading end side (the arrow D direction side) is slightly inclined toward the ejection direction side (the arrow E direction side). The leading end portion of the engaging tab 50 corresponds to the through hole 34 formed in the bottom plate portion 20, and when the lock plate 40 swings to a predetermined engagement position (see FIG. 3) then the sliding of the tongue plate 24 in the ejection direction is latched by the engaging tab 50 passing through the through hole 34 and an engaging hole 26A of the insertion plate portion 26 that has been inserted through between the pair of side wall portions 22.

As shown in FIG. 1, there is a flat planar shaped mounting portion 32A formed at the top face of the above described ejector 32 that corresponds to the engaging tab 50 of the lock plate 40. In the state in which the tongue plate 24 is not inserted between the pair of side wall portions 22, that is to say as shown in FIG. 2, the ejector 32 is in a state of being maintained at the ejection position by the biasing force of the ejector spring 38, this mounting portion 32A stops the lock plate 40 swinging to the bottom plate portion 20 side (the engagement position) by interfering with the leading end portion of the engaging tab 50, and maintains the lock plate 40 in a predetermined released position.

Furthermore, at both sides in the width direction of the engaging tab 50 there is a pair of abutment tabs 52 projecting toward the ejection direction side (the arrow E direction side) from the leading end portion of the base portion 42. The pair of abutment tabs 52 is provided to respectively correspond to a lock member 54, described below.

Figure 4:
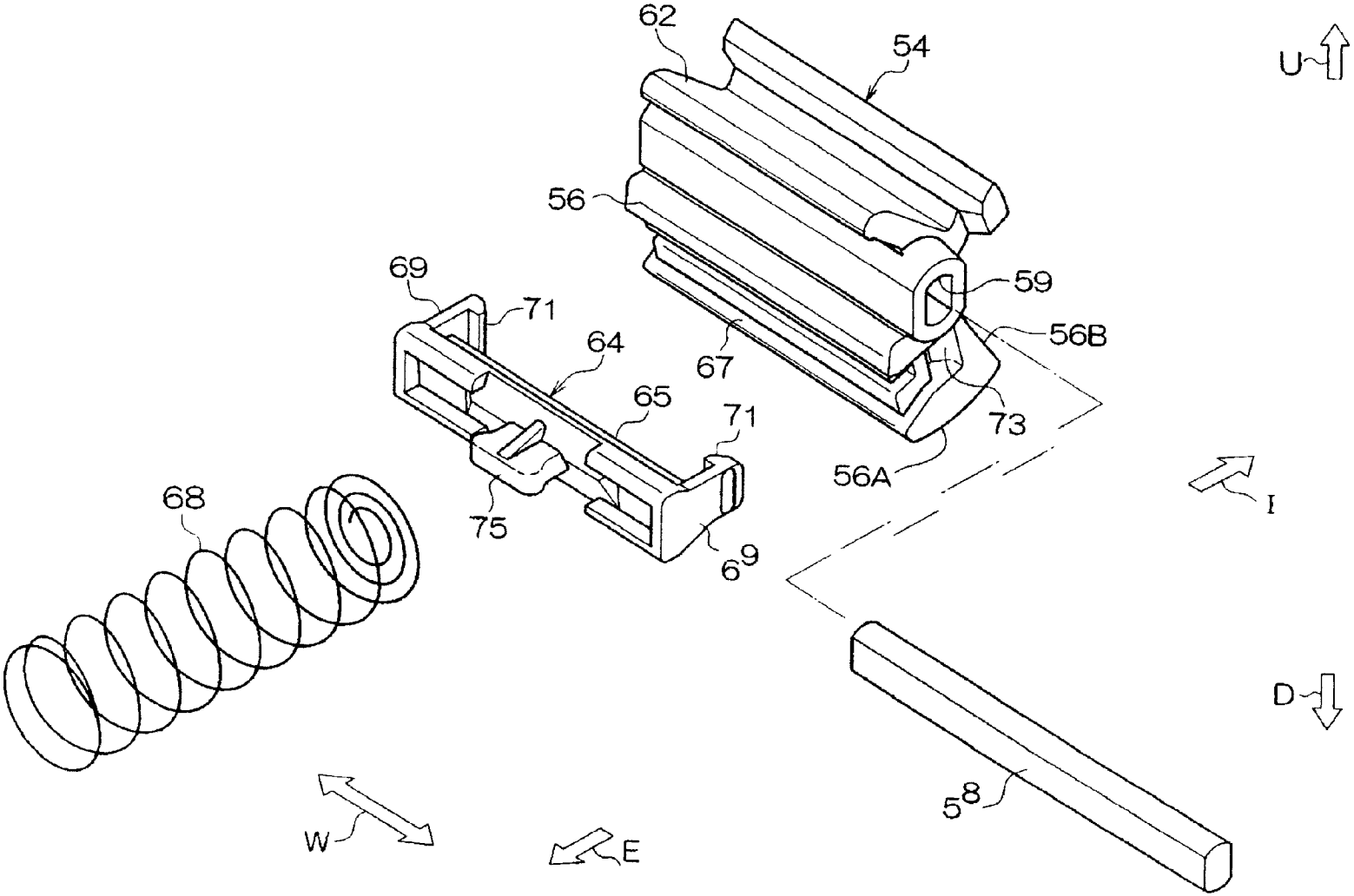
FIG. 4 is an exploded perspective diagram showing the configuration of a lock member, a holder, and a lock spring in the buckle device shown in FIG. 1.

The lock member 54 is disposed at the opposite side of the bottom plate portion 20 via the pair of abutment tabs 52, and is provided with a body portion 56 as shown in FIG. 4. The body portion 56 is a sintered metal that is produced by a "powder metallurgy method" and the body portion 56 is formed in a substantially triangular pole shape with the longitudinal direction thereof being along the direction in which the pair of side wall portions 22 face each other.

Furthermore, the lock member 54 is provided with a shaft 58 that passes through an upper end portion (an end portion at the arrow U direction side) of the body portion 56 along the longitudinal direction thereof. The shaft 58 is formed from a metal material (SUS in the present exemplary embodiment) into a bar shape that is substantially rectangular in cross-section (a so-called "double-D cut shape"). The shaft 58 is press-fined into and fixed in a press-fit hole 59 of substantially rectangular in cross-section (a so-called "double-D cut shape") that is formed in the upper portion of the body portion 56. Both end portions of the shaft 58 in the axial direction respectively protrude out from the both end portions in the longitudinal direction of the body portion 56, and intrude into a pair of engaging holes 60 (see FIG. 1) that are formed in the pair of side wall portions 22. The body portion 56 is supported by the pair of side wall portions 22 such that the body portion 56 is able to swing integrally with the shaft 58.

As is shown in FIG. 4, there is a substantially plate shaped portion to be pressed 62 formed integrally at the upper end side of the body portion 56 (the arrow U direction side) protruding out toward the opposite side from that of the bottom plate portion 20 (the arrow U direction side). This portion to be pressed 62 corresponds to a release button 70, described later.

Furthermore, there is a lock face 56A, which is formed in an circular arc shape with the shaft 58 at the centre thereof, formed at the lower end side of the body portion 56 (the bottom plate portion 20 side, the arrow D direction side). When the lock plate 40 is positioned in the engagement position and also the body portion 56 of the lock member 54 is being maintained in a predetermined lock position (see FIG. 3), the lock face 56A abuts the top face side (the arrow U direction side) of the pair of abutment tabs 52 of the lock plate 40.

Furthermore, there is an abutment surface 56B formed at the other end side of the body portion 56 (the arrow I direction side). When the lock plate 40 is positioned in the release position and also the lock member 54 is being maintained in a predetermined unlock position (see FIG. 2), the abutment surface 56B abuts the leading end of the pair of abutment tabs 52.

Figure 3:
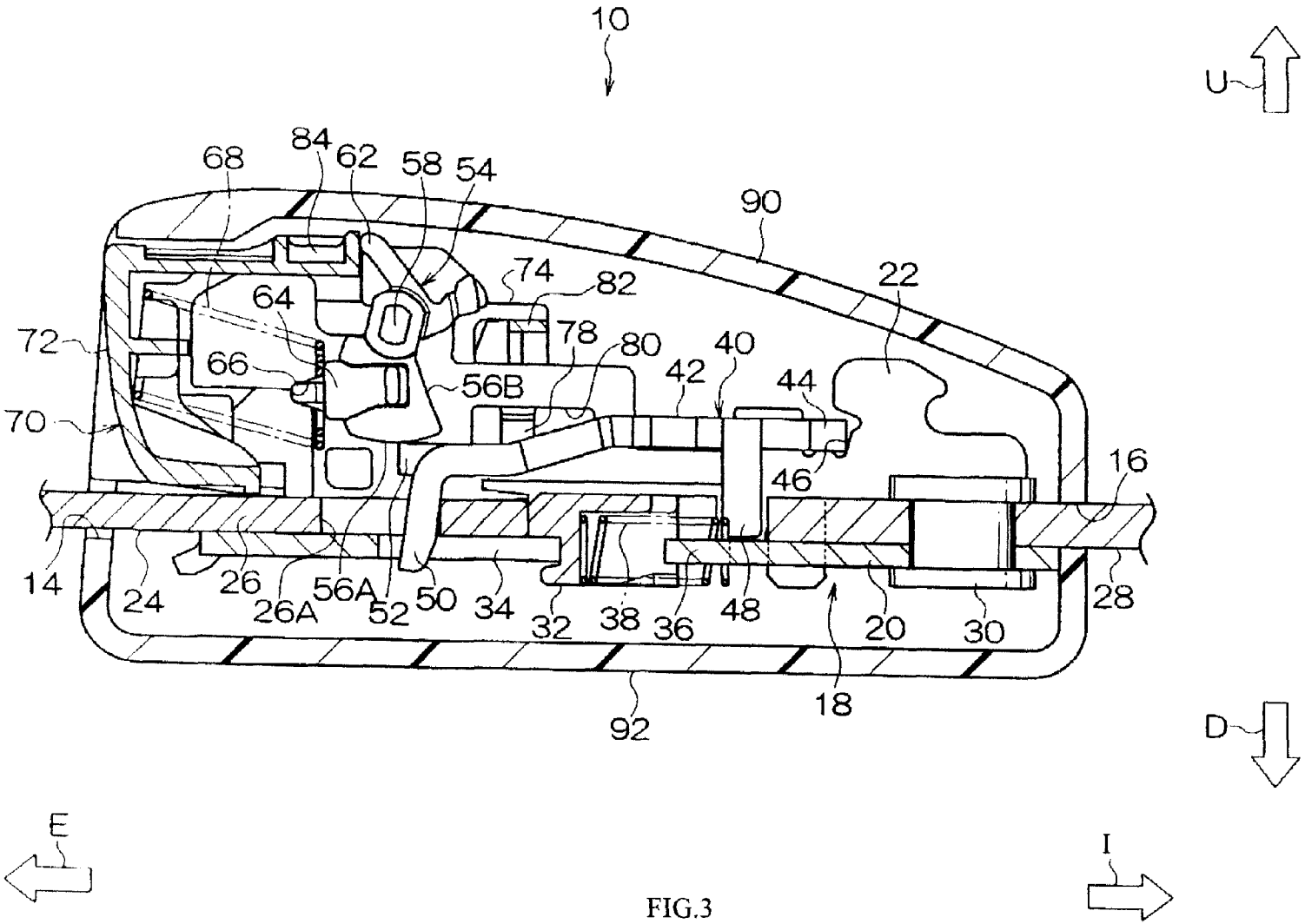
FIG. 3 is a cross-section of the overall configuration of the buckle device shown in FIG. 1, and shows a fastened state thereof.

As is shown in the FIG. 2 and the FIG. 3, there is a holder 64 (see FIG. 4) mounted to one end side of the body portion 56 (the arrow E direction side). The holder 64 is formed from a resin material, and is provided with a base portion 65. The base portion 65 is formed so as to be elongated along the longitudinal direction of the body portion 56, and the base portion 65 is fitted over by a fitting groove 67 that is formed on the body portion 56.

As is shown in FIG. 4, there is a pair of latching portions 69 formed so as to extend toward the body portion 56 side (the arrow I direction side) from both ends in the longitudinal direction of the base portion 65. There are claw portions 71 formed protruding out to the inside (the body portion 56 side) from the two leading ends of the pair of latching portions 69. These claw portions 71 are fitted into latching holes 73 that are formed at both end portions in the longitudinal direction of the body portion 56 (the latching portions 69 and the claw portions 71 are configured as "snap-fit"). By so doing, the holder 64 is mounted to the body portion 56.

At a central portion in the longitudinal direction of the base portion 65 there is a spring holding portion 75 formed protruding out toward the side that is opposite to the side of the body portion 56 (toward the arrow E direction side). This spring holding portion 75 is in correspondence with a lock spring 68, described later. The buckle device 10, as shown in FIG. 1, is provided with a release button 70 disposed at one end side of the buckle body 18. The release button 70 has an operation portion 72 that is manipulated by an occupant, and the operation portion 72 is formed in a box shape that is open to the other end side of the buckle body 18 (the arrow I direction side).

There is a pair of arm portions 74 that extend out toward the insertion direction side (the arrow I direction side) from both end portions in the width direction of the operation portion 72. There are extended portions 76 that respectively extend out toward the bottom plate portion 20 side (the arrow D direction side) from each of the leading end portions of the pair of arm portions 74. There are claw portions 78 formed protruding out toward the pair of side wall portions 22 side (inside) from each of the leading end portions of the pair of extended portions 76, and the claw portions 78 fit into elongated holes 80 that are formed respectively in the pair of side wall portions 22 of the buckle body 18. The elongated holes 80 are formed so as to be elongated along the insertion direction (the arrow I direction) of the tongue plate 24, and each of the claw portions 78 are enabled by the elongated holes 80 to move within a predetermined range along the insertion and ejection direction. By doing so, the movement direction (operation direction) of the release button 70 is limited within the insertion direction and the ejection direction.

Also, there is a substantially bar shaped connecting portion 82 formed with the length thereof in the width direction and spanning between the two leading end portions of the pair of arm portions 74, and the two leading ends of the pair of arm portions 74 are mutually connected by the connecting portion 82.

Furthermore, in the release button 70, there is a pressing portion 84 formed at the upper end side (the arrow U direction side) of the operation portion 72, protruding toward the insertion direction side (the arrow I direction side). The pressing portion 84 is disposed so as to oppose the portion to be pressed 62 of the lock member 54, and when the release button 70 is operated by pressing, the portion to be pressed 62 is pressed to the insertion direction side (the arrow I direction side) by the pressing portion 84, and the body portion 56 of the lock member 54 swings about the shaft 58 toward the ejection direction side (the arrow E direction side, unlock position).

Also, the lock spring 68, which is a compression coil spring, is disposed between the operation portion 72 of the release button 70 and the lock member 54. The holder 64 is disposed between one end of the lock spring 68 and the lock member 54, and one end of the lock spring 68 is latched to the spring holding portion 75 of the holder 64. The other end of the lock spring 68 is pressed against the bottom wall portion of the operation portion 72 of the release button 70, and the lock member 54 is biased toward the lock position (toward the arrow I direction side, the opposite side to that of the release button 70) via the holder 64 by the biasing force of the lock spring 68.

Figure 5:
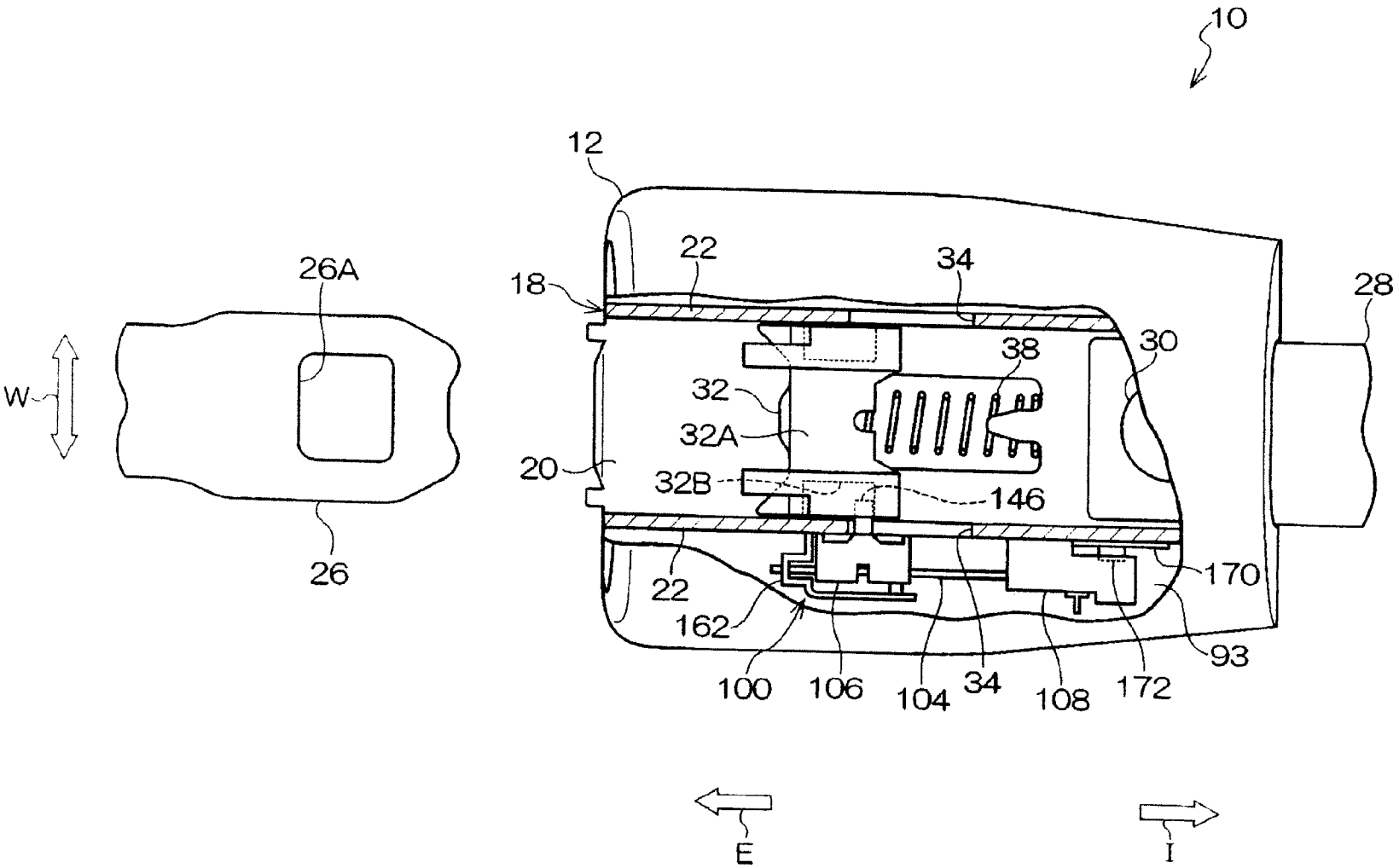
FIG. 5 is a plan view of the buckle device shown in FIG. 1, showing the buckle device in an unfastened state.
Figure 6:
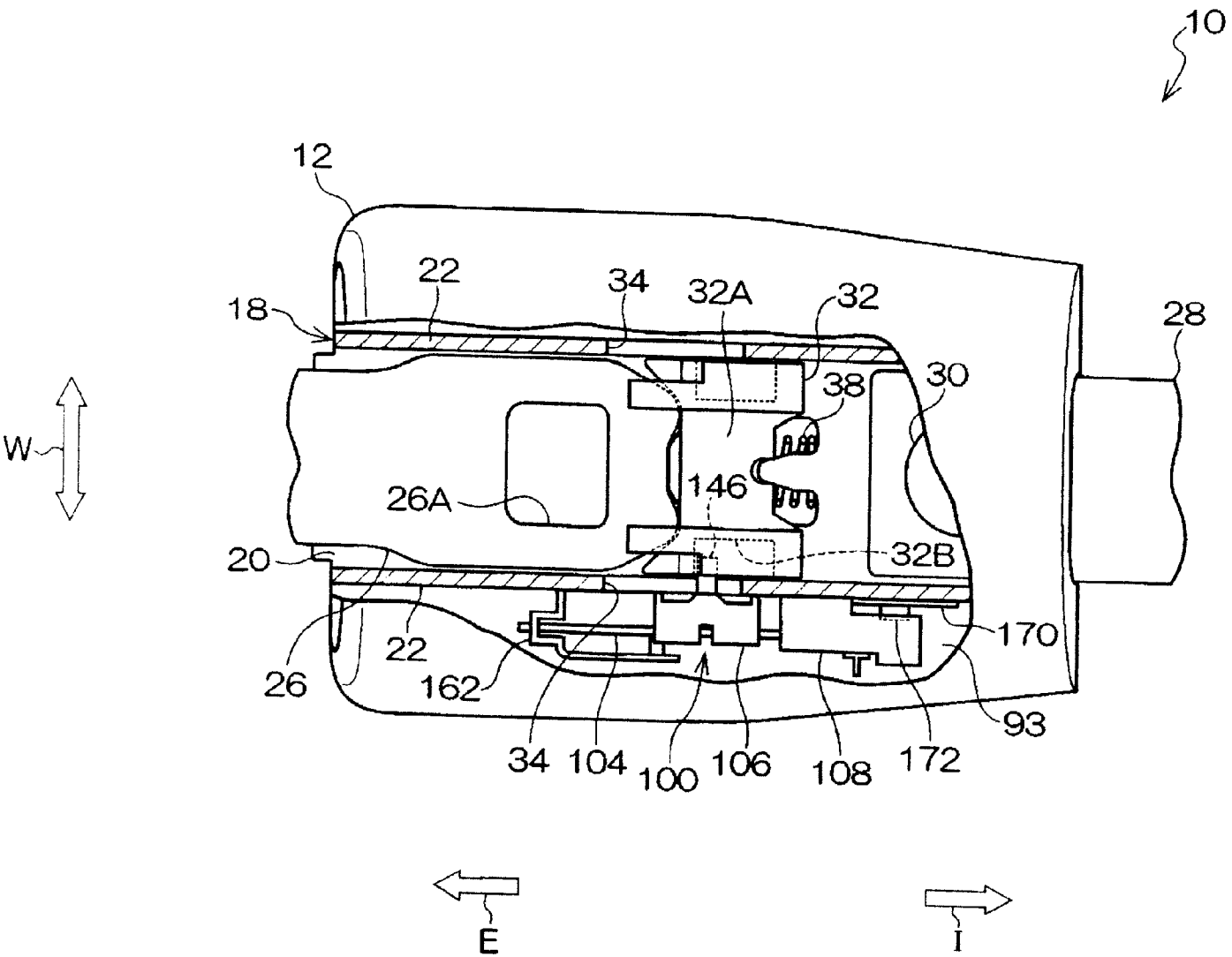
FIG. 6 is a plan view of the buckle device shown in FIG. 1, showing the buckle device in a fastened state.

As shown in FIG. 5 and FIG. 6, a body unit 102 of a buckle switch 100 according to the present exemplary embodiment is mounted to an end portion at one side in the width direction (right side in FIG. 1) at the inside of the lower casing 92. The body unit 102 is connected to a control portion of the vehicle via a cable (not illustrated in the figure), the body unit 102 detects the position of the ejector 32 along the insertion and ejection direction, and the body unit 102 outputs a contact signal to the control portion, corresponding to the position detected.

Figure 7A:
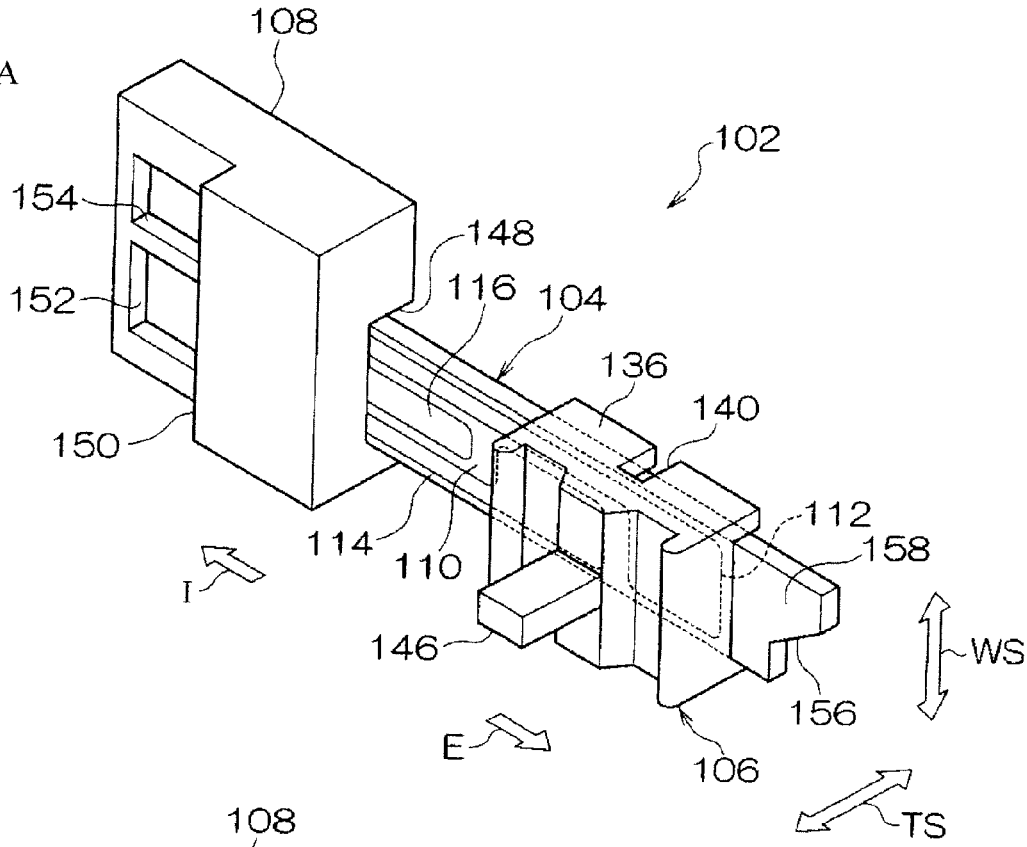
FIG. 7A is a perspective diagram showing a body unit in the buckle switch according to the exemplary embodiment of the present invention.
Figure 7B:
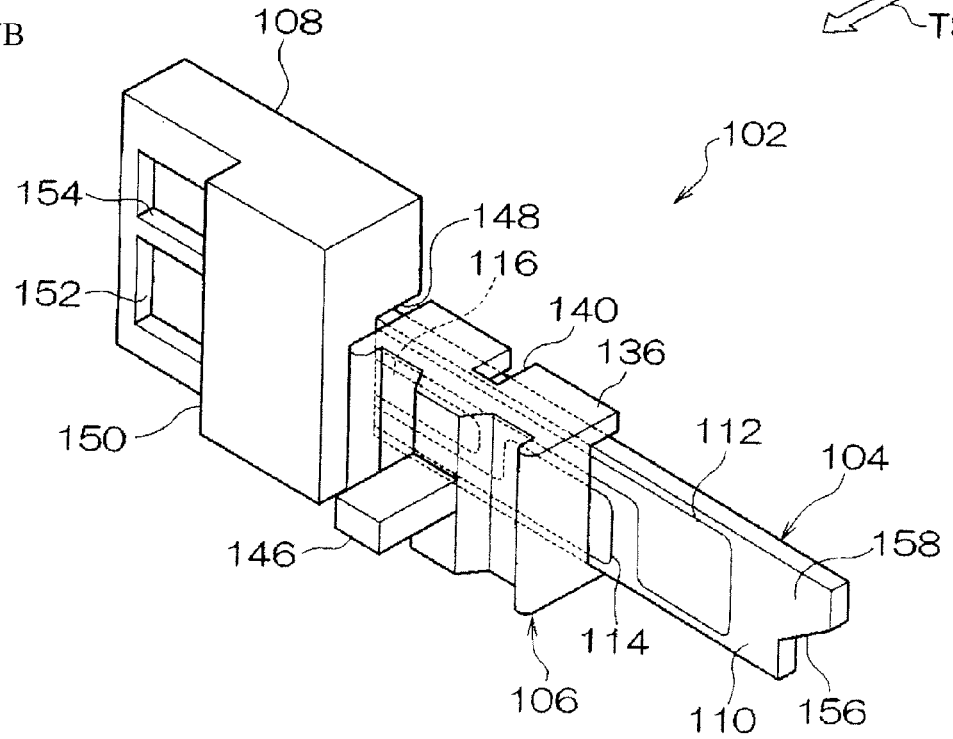
FIG. 7B is a perspective diagram showing the body unit in the buckle switch according to the exemplary embodiment of the present invention.

The buckle switch 100, as shown in FIG. 7A and 7B, is provided with: a switch base plate 104 that is formed as a long narrow plate shape along the insertion and ejection direction; a sliding member 106 that is assembled to the switch base plate 104, and that is supported by the switch base plate 104 so as to be slidable along the insertion and ejection direction; and a base plate base 108 that is fixed and connected to a base end portion of the switch base plate 104. The switch base plate 104, sliding member 106, and base plate base 108 configure the body unit 102 of the buckle switch 100.

The switch base plate 104 is formed from an electrically insulating material, and one of the faces thereof in the thickness direction is a sliding surface 110. There are plural (3 in the present exemplary embodiment) conducting patterns 112, 114, and 116 (see FIG. 8A and FIG. 8B) formed on the sliding surface 110, and the conducting patterns 112, 114, and 116 are insulated from each other by metallic films.

Figure 9A:
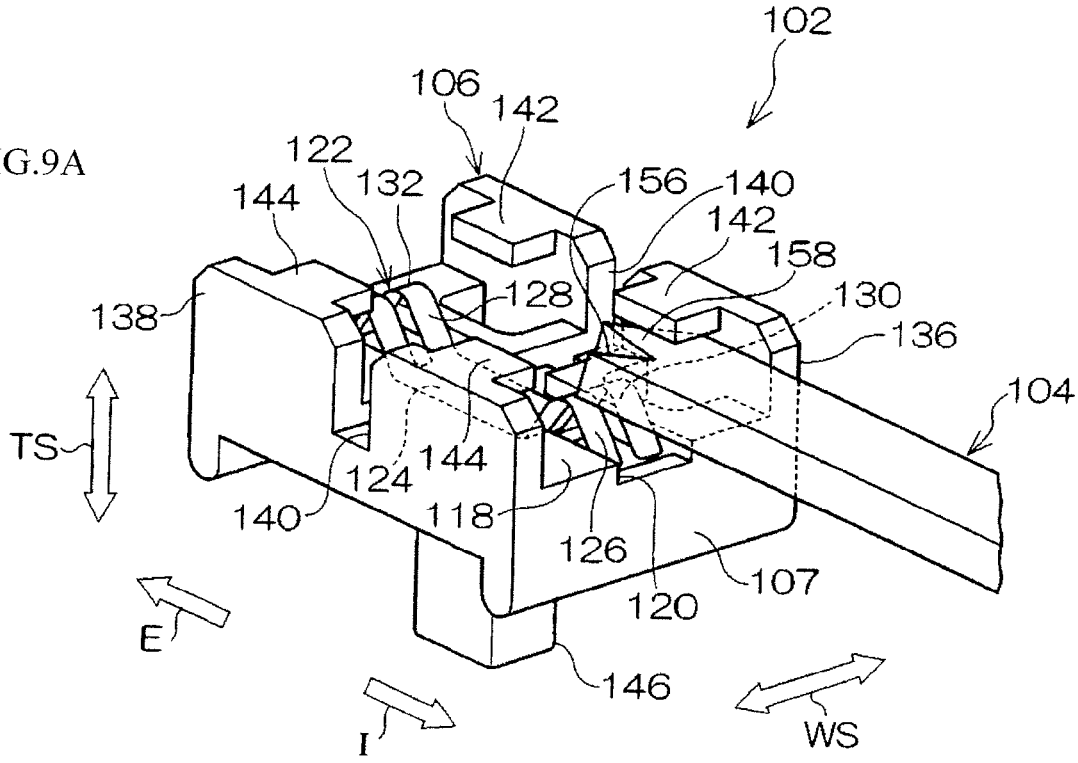
FIG. 9A is a perspective diagram showing a slider member and a switch base plate according to the exemplary embodiment of the present invention, and shows the state in which a first process for assembling the slider member to the switch base plate is being carried out.
Figure 9B:
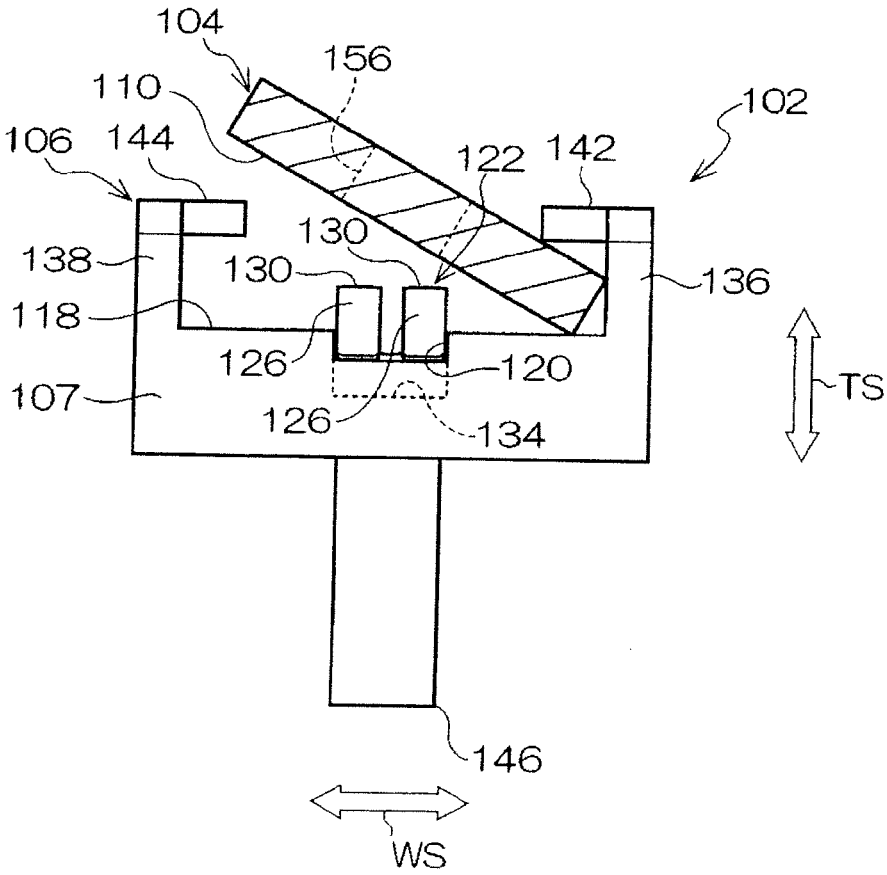
FIG. 9B is a front view showing the slider member and the switch base plate according to the exemplary embodiment of the present invention, and shows the state in which the first process for assembling the slider member to the switch base plate is being carried out.

As shown in FIG. 9A and 9B, there is a thick plate shaped body portion 107 provided to the sliding member 106 at an intermediate portion thereof in the thickness direction (the arrow TS direction). The body portion 107 is formed as substantially a rectangular plate shape that is elongated in the insertion and ejection direction when seen in plan view, and the top face side of the body portion 107 is a guide surface 118 that directly opposes the sliding surface 110 of the switch base plate 104. There is a groove portion 120 that is rectangular in cross-section formed at the guide surface 118, extending along the insertion and ejection direction at a central portion in the width direction (the arrow WS direction) of the guide surface 118. A thin metal plate contact member 122 is disposed inside of the groove portion 120.

The contact member 122, as shown in FIGS. 8A and 8B and FIGS. 9A and 9B, is formed overall in a long thin beam shape along the insertion and ejection direction, and at a central portion thereof in the longitudinal direction there is provided a base portion 124 that is fixed tightly to the bottom face of the groove portion 120. In the contact member 122 there is a pair of flexible tabs 126 formed extending out from one end side of the base portion 124 along the insertion and ejection direction, and there is also a pair of flexible tabs 128 formed extending out from the other end side of the base portion 124.

The pair of flexible tabs 126 extend respectively in the insertion direction (the arrow I direction) from both end portions in the width direction of the base portion 124, and the pair of flexible tabs 126 are supported in a cantilever manner by the base portion 124. Also, the base end portions of the pair of flexible tabs 126 are bent so as to be inclined toward the sliding surface 110 side of the switch base plate 104, and also the intermediate portions in the longitudinal direction of the pair of flexible tabs 126 are bent around in the reverse direction to that of the base end portions so as to be inclined toward the guide surface 118 side. By so doing, the shape of the pair of flexible tabs 126 overall becomes that of a V-shaped bent cantilevered beam, being deformable so as to bow in the thickness direction thereof. Furthermore, the curved portions that are formed in the intermediate portion in the longitudinal direction of the pair of flexible tabs 126 become contact portions 130 that contact with the sliding surface 110 of the switch base plate 104 (with the conducting patterns 112, 114, and 116).

The pair of flexible tabs 128 are formed and disposed along the insertion and ejection direction so as to be symmetrical to the pair of flexible tabs 126 (linear symmetric), and there are contact portions 132 formed at the intermediate portions in the longitudinal direction of the pair of flexible tabs 128, contacting with the sliding surface 110 of the switch base plate 104 (with the conducting patterns 112, 114, and 116).

Also, as shown in FIG. 9B, there are concave recessed portions 134 formed in the portions in the bottom face of the groove portion 120 of the body portion 107, at positions that respectively oppose the pair of flexible tabs 126 and the pair of flexible tabs 128, and by doing so, even if the amount of bending deformation of the flexible tabs 126, 128 becomes large, the flexible tabs 126, 128 do not contact with the portions in the bottom face of the groove portion 120 and the flexible tabs 126, 128 are able to carry out bending deformation.

There are plate shaped guide members 136, 138 integrally formed to the sliding member 106 along both ends in the width direction of the guide surface 118. The pair of guide members 136, 138 are each formed into substantially rectangular flat plate shapes, and extend in a direction (the thickness direction) that is orthogonal to the guide surface 118, and are disposed extending in straight lines along the insertion and ejection direction. Also, the separation in the width direction between the pair of guide members 136 and 138 is slightly wider than the width of the switch base plate 104. By doing so, when the switch base plate 104 is inserted between the pairs of guide members 136, 138, the switch base plate 104 is guided so as to move in a straight line along the insertion and ejection direction.

There are cut-out portions 140 formed in respective intermediate portions along the insertion and ejection direction of the pair of guide members 136, 138, and the cut-out portions 140 are provided such that when the contact member 122 is being assembled to the inside of the groove portion 120 of the sliding member 106 using a jig, the jig is guided to the groove portion 120 side and the sliding member 106 interferes with the jig.

There is a pair of first claw portions 142 formed integrally to one guide member 136 and extending out to the inside in the width direction from the leading end portions of the guide member 136. The pair of first claw portions 142 is disposed to the guide member 136 at one end side and at the other end side, in the insertion and ejection direction, respectively. The pair of first claw portions 142 is formed so as to be substantially rectangular flat plate shaped, and the restoring force of the first claw portions 142 is configured so as to be greater than the restoring force in the bending direction of the pair of flexible tabs 126 in the contact member 122. There is also a pair of second claw portions 144 formed to the other guide member 138, and the pair of second claw portions 144 are formed and disposed so as to be symmetrical to the pair of first claw portions 142 of the guide member 136.

There is an engaging projection 146 formed integrally to the sliding member 106 at the face side thereof that is opposite to the side of the guide surface 118 of the body portion 107. The engaging projection 146 is disposed in a central position in the width direction and in the insertion and ejection direction of the body portion 107, and the engaging projection 146 projects out in the thickness direction to the side of the ejector 32 that is disposed between the pair of side wall portions 22 of the buckle body 18. When the buckle switch 100, as shown in FIG. 5 and FIG. 6, is in a mounted state to the inside of the lower casing 92, the leading end side of the engaging projection 146 of the sliding member 106 is inserted into the engaging recessed portion 32B of the ejector 32. By doing so, the sliding member 106 is connected to the ejector 32 via the engaging projection 146 and the engaging recessed portion 32B, and the sliding member 106 moves integrally with the ejector 32 in the insertion direction and the ejection direction.

As shown in FIGS. 7A and 7B, there is a recessed shaped fit insertion portion 148 formed to the base plate base 108 at one face thereof (one end face) at one side in the thickness direction (the right side in FIGS. 7A and 7B), and the fit insertion portion 148 extends from the leading end face of the base plate base 108 out to the rear end face side. The rear end side of the switch base plate 104 fits into the fit insertion portion 148 and also the outer peripheral edges of the switch base plate 104 are latched by plural latching lugs (not illustrated in the figure) that are formed so as to protrude from the inside wall of the fit insertion portion 148. By doing so, the base end side of the switch base plate 104 is connected and fixed to the base plate base 108 in a state in which the leading end side of the switch base plate 104 is protruding out from the leading end face of the base plate base 108. Also, there is a step portion 150 formed at a central portion in the insertion and ejection direction of the other end face of the base plate base 108, and through the step portion 150, the thickness of the base plate base 108 is thinner at the base end side than it is at the leading end side thereof There is a recessed portion 152 formed at the other end face of the base plate base 108 at the base end side relative to the step portion 150, and also a latching rib 154 is formed across inside the recessed portion 152 along the insertion and ejection direction. The latching rib 154 extends along the insertion and ejection direction and the width thereof in the thickness direction is equivalent to the depth of the recessed portion 152.

Figure 8A:
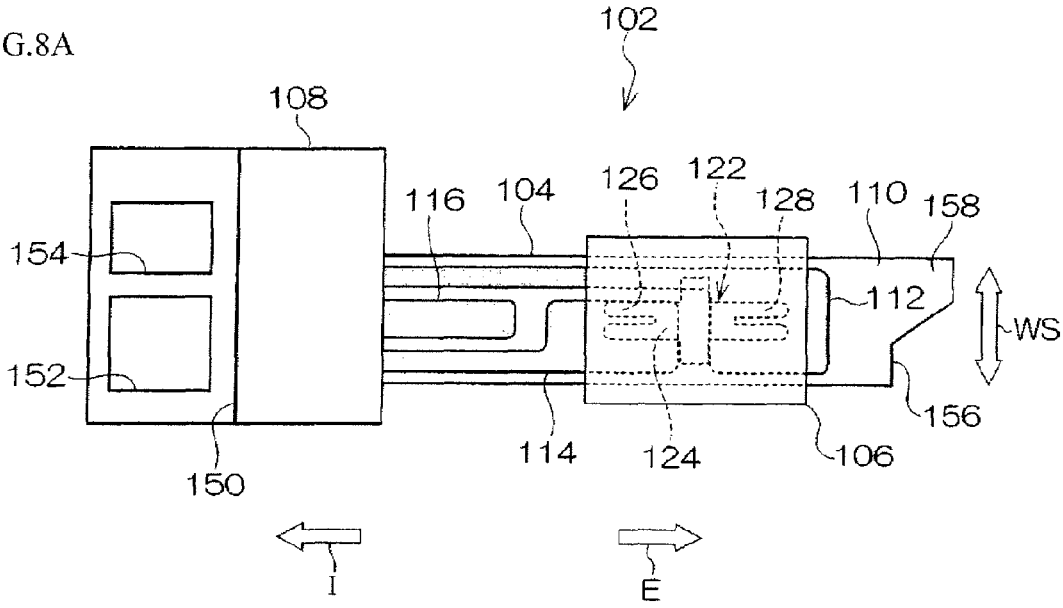
FIG. 8A is a lateral view showing the body unit in the buckle switch according to the exemplary embodiment of the present invention.
Figure 8B:
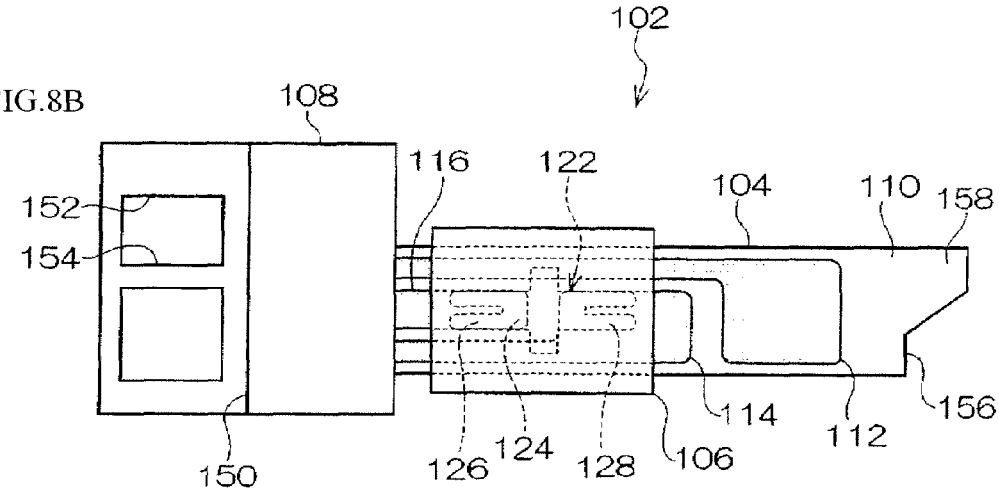
FIG. 8B is a lateral view showing the body unit in the buckle switch according to the exemplary embodiment of the present invention.

As shown in FIG. 8A and FIG. 8B, there is a substantially trapezoidal shaped cut-out portion 156 provided at the other end side in the width direction of the leading end portion of the switch base plate 104 (the lower side in FIG. 8A and FIG. 8B). Thereby, at the leading end portion of the switch base plate 104, a substantially trapezoidal extended portion 158 is provided at one end side extending out in the ejection direction with respect to the other end side of the switch base plate 104. One end face of the extended portion 158 at one side in the width direction (one end face) is disposed extending in a direction that is parallel to the insertion and ejection direction, and the other end face in the width direction is inclined to the width direction inside from the base end side of the extended portion 158 toward the leading end side thereof In this way, the width of the extended portion 158 gets gradually narrower on progression from the base end portion to the leading end portion thereof Furthermore, the cut-out portion 156 of the switch base plate 104 is provided to correspond to one of the pair of second claw portions 144 in the sliding member 106 which is at the insertion direction side. Basically, the cut-out portion 156 is provided so that, as shown in FIGS. 9A and 9B, in the state in which the edge portion of the extended portion 158 is latched by one of the first claw portions 142 that is positioned at the insertion direction side, the leading end portion of the switch base plate 104 is in a state of non contact with one of the second claw portions 144 that is positioned at the insertion direction side.

Figure 11:
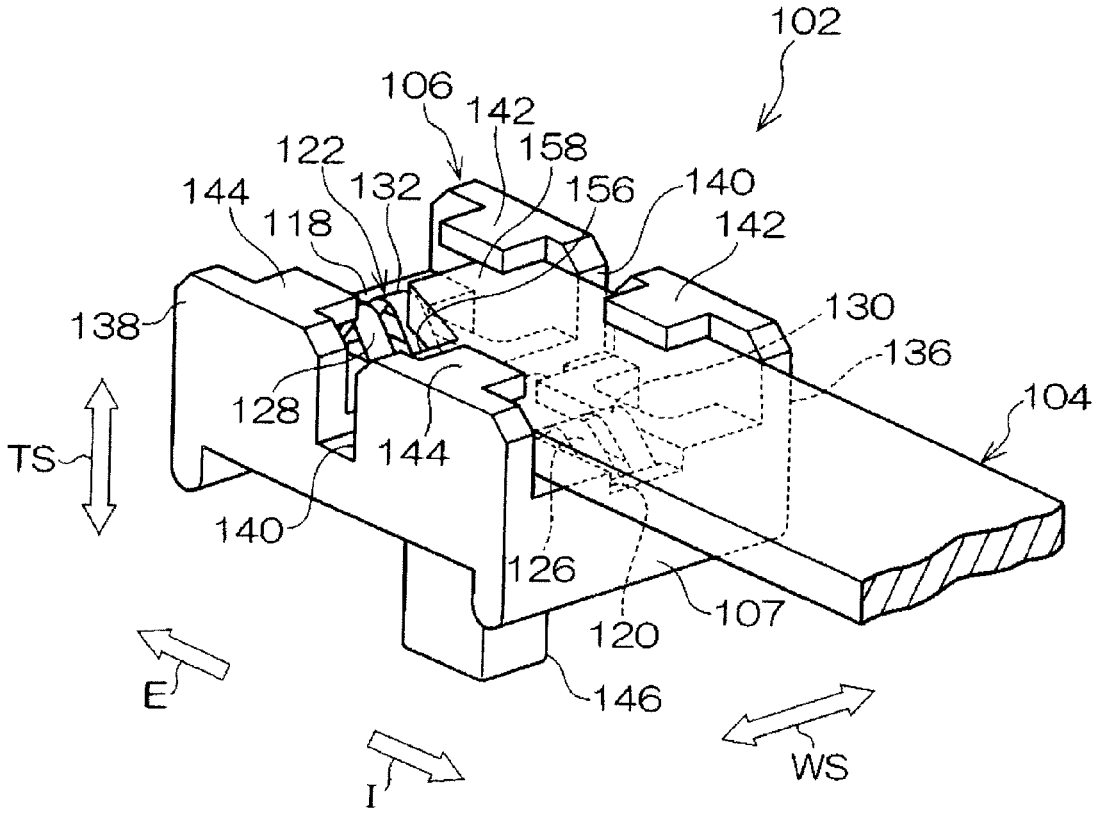
FIG. 11 is a perspective diagram showing the slider member and the switch base plate according to the exemplary embodiment of the present invention, and shows the state in which a third process for assembling the slider member to the switch base plate is being carried out.

In the buckle switch 100, as shown in FIGS. 7A and 7B and FIGS. 8A and 8B, the leading end side of the switch base plate 104 is inserted between the guide members 136, 138 of the sliding member 106, and also, the edge portions on the two sides in the width direction of the switch base plate 104 are respectively latched by the first claw portions 142 and second claw portions 144. Here, as shown in FIG. 11, the sliding surface 110 of the switch base plate 104 and the guide surface 118 of the sliding member 106 are in direct opposition to each other, and the pairs of flexible tabs 126, 128 of the contact member 122 are retained, respectively, in a state of bending deformation toward the front face side of the sliding member 106 due to the pressing force from the sliding surface 110. Due to this, the sliding member 106 is supported so as to be able to slide along the longitudinal direction of the sliding surface 110 (insertion and ejection direction).

The sliding member 106 that is supported so as to be able to slide by the switch base plate 104, is able to slide along the insertion and ejection direction between an ejection position shown in FIG. 7A and an insertion position shown in FIG. 7B. The ejection position and insertion position of the sliding member 106 along the insertion and ejection direction match, respectively, the ejection position and insertion position of the ejector 32.

The body casing 12 of the buckle device 10 configures a part of the buckle switch 100 according to the present exemplary embodiment. That is to say, the body casing 12 is configured as a housing portion for accommodating the body unit 102 which is provided with the switch base plate 104, the base plate base 108 and the sliding member 106.

Figure 12A:
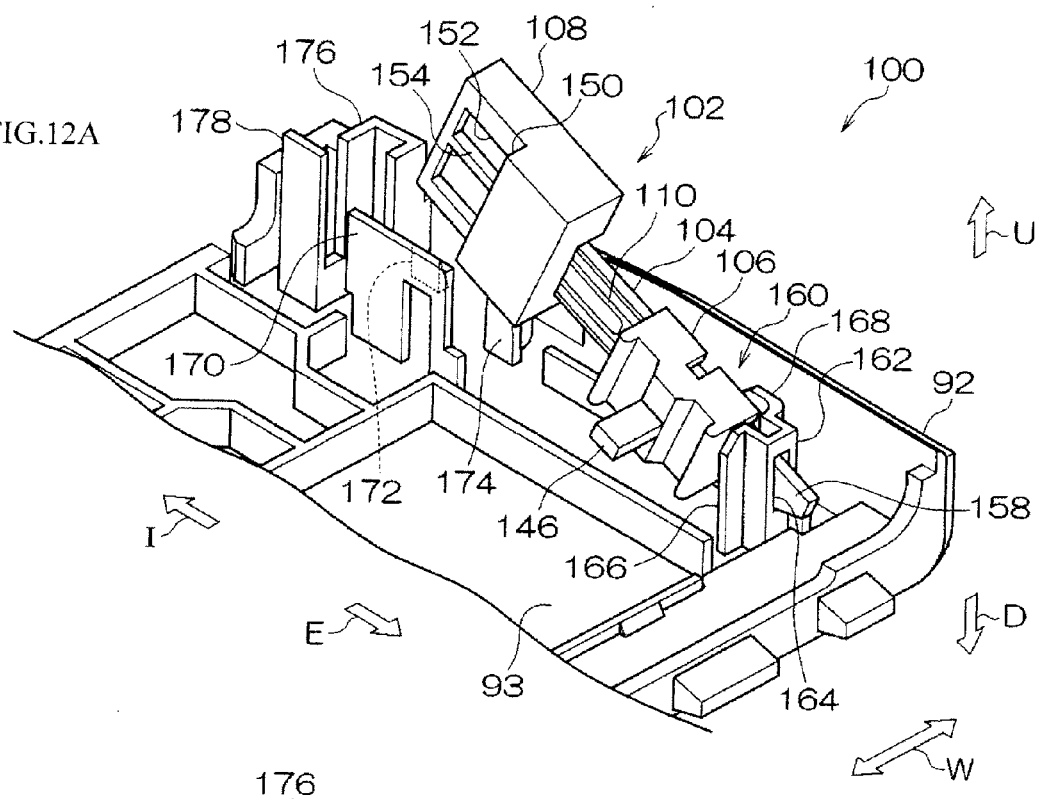
FIG. 12A is a perspective diagram showing the slider member and the switch base plate according to the exemplary embodiment of the present invention, and shows the state in which a fourth process for assembling the slider member to the switch base plate is being carried out.
Figure 12B:
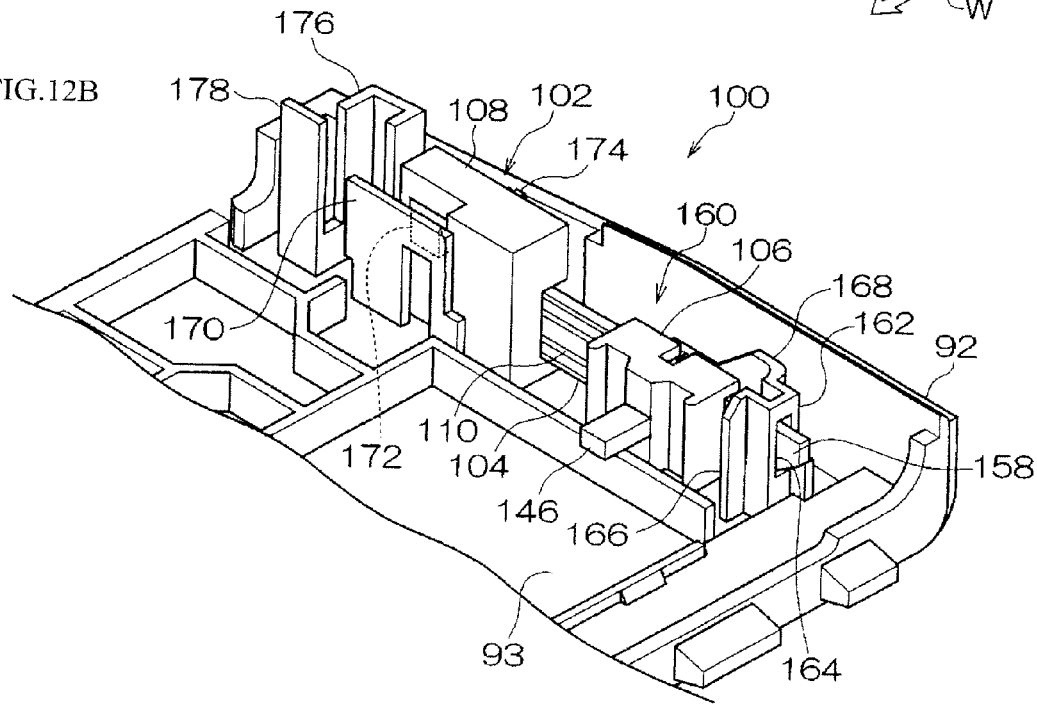
FIG. 12B is a perspective diagram showing the slider member and the switch base plate according to the exemplary embodiment of the present invention, and shows the state in which a fifth process for assembling the slider member to the switch base plate is being carried out.

As shown in FIGS. 12A and 12B, a substantially rectangular bottom plate portion 93 is formed in the lower casing 92 of the body casing 12, and above this bottom plate portion 93, a switch mounting portion 160 is provided at one end side in the width direction (the arrow W direction). The body unit 102 is mounted to the switch mounting portion 106.

There is a support bracket 162 provided to the switch mounting portion 160 at an end portion at the ejection direction side, with the support bracket 162 projecting out from the bottom plate portion 93. The support bracket 162 is formed substantially in a U-shape, with the opening thereof facing toward the insertion direction when a cross-section is taken along the insertion and ejection direction. Passing through a wall portion at the outside in the ejection direction of the support bracket 162, there is a long and thin fitting insertion hole 164 that is along the thickness direction (the arrow D direction). The fitting insertion hole 164 corresponds to the extended portion 158 in the switch base plate 104, and the width in the thickness direction of the fitting insertion hole 164 is slightly wider than the width of the leading end portion of the extended portion 158, and also the width in the width direction of the fitting insertion hole 164 is slightly wider than the thickness of the switch base plate 104.

A stopper portion 166 that restricts movement to the ejection direction side of the sliding member 106 which is slidably supported switch base plate 104 is integrally formed to the support bracket 162, and a base plate abutment portion 168 is integrally formed to the support bracket 162, abutting the reverse face side of the switch base plate 104, which is the opposite side to that of the sliding surface 110, and restricting displacement (jolting) of the switch base plate 104 in the width direction.

There is a latching lug 170 provided in the switch mounting portion 160 at an end portion thereof at the insertion direction side, protruding out from the bottom plate portion 93. The latching lug 170 is formed in a substantially rectangular plate shape with the length thereof in the insertion and ejection direction, and the thickness direction of the latching lug 170 is in the same direction as the width direction of the device (the arrow W direction). There is a latching claw portion 172 formed integrally to the latching lug 170 at the leading end side on the outside face in the width direction thereof, and the latching claw portion 172 corresponds to the latching rib 154 of the base plate base 108. The latching claw portion 172 has cross-section with a slope shape with the thickness thereof gradually increasing on progression from the leading end side to the base end side of the latching lug 170, and the bottom end face at the base end side of the latching claw portion 172 is able to latch to the top face side of the latching rib 154.

There is a base abutment portion 174 formed to the lower casing 92, protruding out from the bottom plate portion 93 so as to correspond with the latching lug 170 in the width direction of the device, and the base abutment portion 174 abuts one end face in the thickness direction of the base plate base 108, and restricts displacement (jolting) in the width direction of the base plate base 108. Furthermore, there is a pair of guide protrusions 176, 178 formed to the bottom plate portion 93 of the lower casing 92, at the insertion direction side relative to the latching lug 170 and the base abutment portion 174. In the body casing 12, a cable (not illustrated in the figure) extending from the back end side of the base plate base 108 is guided through between the guide protrusions 176, 178 and out to the anchor insertion slot 16 side.

(Buckle Switch Assembly Method)

Explanation will now be given of an assembly method for the buckle device 10 according to the present exemplary embodiment configured as above.

First, when assembling the body unit 102 of the buckle switch 100, as shown in FIG. 9A and FIG. 9B, while inclining the sliding surface 110 of the switch base plate 104 in the width direction (the arrow WS direction) relative to the guide surface 118, the edge portion of the extended portion 158 is latched by one of the first claw portion 142 that is at the insertion direction side (first process). When this is carried out, the leading end portion of the switch base plate 104 is in a state in which it is separated from the second claw portions 144, and also the sliding surface 110 is separated from the contact member 122.

Figure 10A:
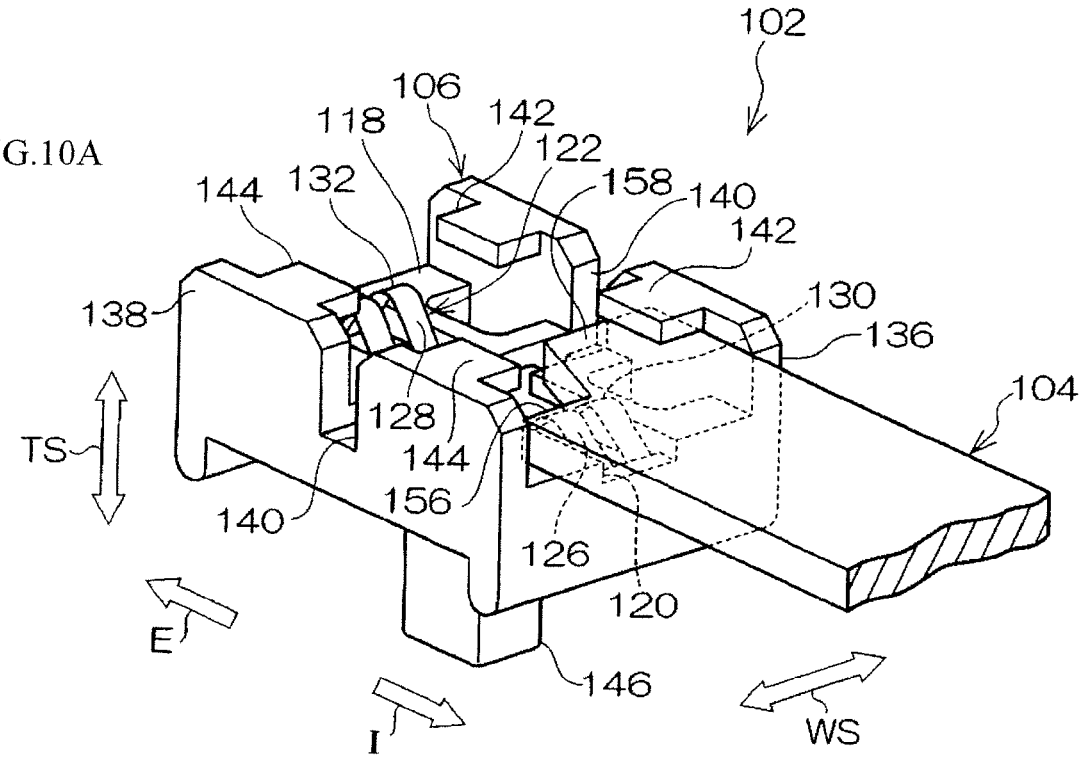
FIG. 10A is a perspective diagram showing the slider member and the switch base plate according to the exemplary embodiment of the present invention, and shows the state in which a second process for assembling the slider member to the switch base plate is being carried out.
Figure 10B:
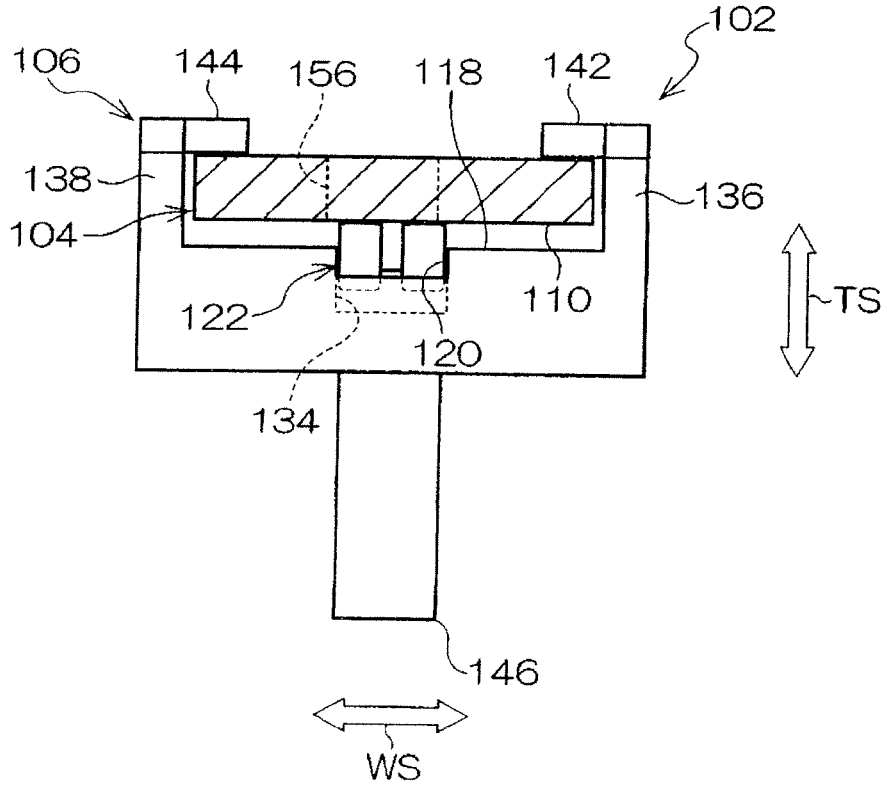
FIG. 10B is a front view showing the slider member and the switch base plate according to the exemplary embodiment of the present invention, and shows the state in which the second process for assembling the slider member to the switch base plate is being carried out.

Next, as shown in FIGS. 10A and 10B, the switch base plate 104 is swung, with one first claw portion 142 that latches the extended portion 158 as a center, to the position where the sliding surface 110 is made substantially parallel to the guide surface 118, and one of the flexible tabs 126 of the contact member 122 is bending deformed by a predetermined amount due to the pressing force from the sliding surface 110 (second process). When this is carried out, as shown in FIG 10B, by the intrusion of the leading end sides of the flexible tabs 126 into the concave recessed portions 134, the leading end sides are held in a state of non contact with the sliding member 106. Furthermore, when the switch base plate 104 is being swung from the position shown in FIGS. 9A and 9B to the position shown in FIGS. 10A and 10B, the switch base plate 104 is held in a state of non contact with the second claw portion 144 due to the cut-out portion 156.

Next, as shown in FIG. 11, by pressing the switch base plate 104 in the ejection direction (the arrow E direction) and by moving (sliding) the switch base plate 104, the extended portion 158 of the switch base plate 104 and the base end side of the cut-out portion 156 are latched by the first claw portion 142 and the second claw portion 144 that are at the ejection direction side, and also the other flexible tabs 128 of the contact member 122 are deformed by a predetermined amount of bending by the sliding surface 110 of the switch base plate 104 (third process). When this is carried out, the sliding surface 110 of the switch base plate 104 reaches abutment with flexible tabs 128 from the base portion 124 side, and since the sliding surface 110 is guided smoothly on the flexible tabs 128 by the boundary portion between the base portion 124 and the pair of flexible tabs 126, there is no unreasonable force acting thereon.

Then, as shown in FIGS. 7A and 7B, the switch base plate 104 is moved (slid) further in the ejection direction (the arrow E direction), and the extended portion 158 and the base end side of the cut-out portion 156 of the switch base plate 104 are latched by the pair of first claw portions 142 and the pair of second claw portions 144. Thereby, the sliding member 106 is assembled to the switch base plate 104, and the assembly of the body unit 102 of the buckle switch 100 is complete.

Next, explanation will be given of an assembly method of the body unit 102 to the mounting portion 160 of the lower casing 92.

First, as shown in FIG. 12A, the extended portion 158 of the switch base plate 104 is fitted in the ejection direction into the fitting insertion hole 164 of the support bracket 162 (fourth process). When this is carried out, the base plate abutment portion 168 is abutted against the surface of the switch base plate 104 that is on the opposite side to the side of the sliding surface 110.

Next, when the base plate base 108 side of the body unit 102 is swung to the bottom plate portion 93 side, the other end face of the base plate base 108 abuts the inclined face at the upper side of the latching claw portion 172 of the latching lug 170, and the latching lug 170 is deformed to bend toward the inside in the width direction (the arrow W direction). Then, as shown in FIG. 12B, when the base plate base 108 is swung to the position where it is in contact with the bottom plate portion 93, the latching lug 170 recovers and also latches with the latching rib 154 at the base plate base 108 due to the latching claw portion 172 (fifth process). Thereby the body unit 102 is fixed to the switch mounting portion 160, and the assembly of the buckle switch 100 is completed.

OPERATION OF THE EXEMPLARY EMBODIMENT

Explanation will now be given of the operation of a switch device according to the present exemplary embodiment, and of the operation of a buckle device to which such a switch device has been applied.

In the buckle device 10, when the insertion plate portion 26 of the tongue plate 24 in the unfastened state shown in FIG. 2, is inserted from the tongue insertion slot 14 of the body casing 12, as shown in FIG. 3, the leading end of the insertion plate portion 26 contacts with the end portion of the ejector 32 and presses, and the ejector 32 in the ejection position is slid to the insertion direction side (the arrow I direction side) against the biasing force of the ejector spring 38. When this happens, the sliding member 106 of the buckle switch 100 that has become integrated to the ejector 32 also slides from the ejection position to the insertion position side.

When the ejector 32 slides by a predetermined amount to the insertion direction side and reaches the insertion position, the opposing state between the mounting portion 32A of the ejector 32 and the engaging tab 50 of the lock plate 40 is released, and also the ejector 32 presses the pair of arm portions 48 of the lock plate 40, and swings the lock plate 40 toward the bottom plate portion 20 side (engagement position). When this occurs, the sliding member 106 that has become integrated to the ejector 32 also reaches the insertion position.

Thereby, the leading end portion of the engaging tab 50 moves to the vicinity of the bottom plate portion 20. Furthermore, in this state, the engaging hole 26A of the insertion plate portion 26 and the through hole 34 formed in the bottom plate portion 20 overlap each other. Therefore, in this state, as shown in FIG. 3, the engaging tab 50 that has been swung passes through the engaging hole 26A of the insertion plate portion 26 and through the through hole 34 of the bottom plate portion 20.

Also, by the swinging of the lock plate 40 to the engagement position, the abutting state of the pair of abutment tabs 52 of the lock plate 40 and the abutment surface 56B of the lock member 54 is released. Here, since the biasing force of the lock spring 68 is received by the lock member 54 via the holder 64, the body portion 56 of the lock member 54 swings to the insertion direction side (the arrow I direction, lock position) by the biasing force of the lock spring 68 as coupled to the swinging of the lock plate 40, and the lock face 56A of the body portion 56 abuts with the face (face at the arrow U direction side) of the pair of abutment tabs 52 (the state shown in FIG. 3). Therefore, swinging of the lock plate 40 toward the release position (swinging in the direction of separation of the engaging tab 50 from the bottom plate portion 20) is restricted, and thereby the mounted state (latched state) of the tongue plate 24 to the buckle device 10 is arrived at.

On the other hand, in the above mounted state of the tongue plate 24, if the operation portion 72 of the release button 70 is operated by pressing, the portion to be pressed 62 of the lock member 54 is pressed to the other end side in the longitudinal direction of the bottom plate portion 20 (the arrow I direction side) by the pressing portion 84 of the release button 70, and the body portion 56 of the lock member 54 is swung toward the ejection direction side (the arrow E direction side, unlock position) against the biasing force of the lock spring 68.

Therefore, the abutment state of the lock face 56A of the body portion 56 and the pair of abutment tabs 52 of the lock plate 40 is released, and the restriction of swinging (movement prevention) of the lock plate 40 by the lock member 54 is released. Further, since the biasing force of the ejector spring 38 acts on the engaging tab 50 of the lock plate 40, through the insertion plate portion 26 of the tongue plate 24 and the ejector 32, a component of the force acts on the engaging tab 50 in the direction of separation from the bottom plate portion 20. Therefore, the lock plate 40 is separated from the bottom plate portion 20 by the component of force acting on the engaging tab 50, and the lock plate 40 is swung to the release position, and the retaining of the tongue plate 24 by the engaging tab 50 is released. By doing so, when the ejector 32 slides to the ejection direction side (the arrow E direction side) due to the biasing force of the ejector spring 38 and reaches the ejection position, the insertion plate portion 26 of the tongue plate 24 is ejected from the tongue insertion slot 14 of the body casing 12 due to the sliding of the ejector 32. At this time, the sliding member 106 of the buckle switch 100 also recovers to the ejection position.

In the buckle switch 100 that is applied to the buckle device 10, when the sliding member 106 is in the ejection position shown in FIG. 8A, then, due to the contact member 122 of the sliding member 106, the conducting pattern 112 and the conducting pattern 114 of the switch base plate 104 are in a conduction state, and the conducting pattern 114 and the conducting pattern 116 are in a non conduction state. Thereby, the control portion of the vehicle, which is connected to the buckle switch 100 through the cable, determines that the buckle device 10 is in the unfastened state, and, for example, when the unfastened state of the buckle device 10 continues even after the engine has been started, then a warning light is flashed that encourages the occupant to fasten the buckle device 10.

Also, in the buckle switch 100, when the sliding member 106 is in the insertion position as shown in FIG. 8B, then, due to the contact member 122 of the sliding member 106, the conducting pattern 114 and the conducting pattern 116 of the switch base plate 104 are in a conduction state, and the conducting pattern 112 and the conducting pattern 114 are in a non conduction state. Thereby, the control portion of the vehicle, which is connected to the buckle switch 100 through the cable, determines that the buckle device 10 is in the fastened state, and, for example, after the engine has been started, a motor retractor in a seat belt wind-up device is activated and the tension of the seat belt is adjusted to the correct value.

In the buckle switch 100 according to the present exemplary embodiment described above, the extended portion 158 is formed at the leading end portion of the switch base plate 104, wherein one end side in the width direction of the leading end portion of the switch base plate 104 is extended partially toward the ejection direction relative to the other end side thereof, and the extended portion 158 is caused to be able to be latched by one of the first claw portions 142 that is positioned at the insertion direction side of the sliding member 106. Thereby, when the switch base plate 104 is latched by the first claw portions 142 and the second claw portions 144 of the sliding member 106, the switch base plate 104 may be supported by the sliding member 106 so as to be able to swing with the one of the first claw portions 142 at the insertion direction side as the center by latching the extended portion 158 with the one of the first claw portions 142.

Furthermore, in the buckle switch 100, in the state in which the extended portion 158 is latched by one of the first claw portions 142 as described above, by the cut-out portion 156 that has been formed on the leading end portion of the switch base plate 104 making the leading end portion of the switch base plate 104 be in a non contact state with the second claw portions 144, when the extended portion 158 of the switch base plate 104 is only latched by one of the first claw portions 142, the switch base plate 104 is able to be swung, with one of the first claw portion 142 at the center, from a position where the sliding surface 110 is separated from the contact member 122 to a position where the flexible tabs 126 at the insertion direction side of the contact member 122 are deformed by the sliding surface 110 with a predetermined amount of bending, without contacting with the second claw portions 144.

Therefore, in the buckle switch 100 there is no contact of the switch base plate 104 with the second claw portions 144, and after swinging, with one of the first claw portions 142 at the center, the switch base plate 104 from a position in which the sliding surface 110 is separated from the contact member 122, to a position in which the flexible tabs 126 of the contact member 122 are deformed by the sliding surface 110 with a predetermined amount of bending, if the switch base plate 104 is moved relative to the sliding member 106 toward the ejection direction, and the base end side of the extended portion 158 and the cut-out portion 156 of the switch base plate 104 are inserted between the first claw portions 142 and the second claw portions 144, then both end portions in the width direction of the switch base plate 104 are respectively latched by the first claw portions 142 and the second claw portions 144, and the sliding member 106 can be supported by the switch base plate 104 so as to be slidable.

Here, after the pair of flexible tabs 126 of the contact member 122 is pressed by the sliding surface 110 of the switch base plate 104 and deformed by bending, the base end side of the extended portion 158 and the cut-out portion 156 in the switch base plate 104 is able to be inserted between the first claw portions 142 and the second claw portions 144. Therefore, when the switch base plate 104 is being inserted between the first claw portions 142 and the second claw portions 144, there is no pressing force acting from the switch base plate 104 on the flexible tabs 126 along the ejection direction, and plastic deformation of the flexible tabs 126 of the contact member 122, due to such a pressing force along the ejection direction, may be prevented.

As a result of this, by providing the buckle switch 100, when assembling the sliding member 106 to the switch base plate 104, operations that require a skilled operator become unnecessary, and also, when inserting the switch base plate 104 between the first claw portions 142 and the second claw portions 144, since plastic deformation of the contact member 122 due to the pressing force from the switch base plate 104 is eliminated, the sliding member 106 may be assembled simply to the switch base plate 104, and damage to the contact member 122 disposed on the sliding member 106 during assembly is effectively prevented.

Furthermore, in the buckle switch 100 according to the present exemplary embodiment, the extended portion 158 of the switch base plate 104 is able to be inserted into the fitting insertion hole 164 of the support bracket 162 provided in the lower casing 92 along the ejection direction, and also in the state in which the extended portion 158 of the switch base plate 104 has been fitted into the fitting insertion hole 164, by providing on the lower casing 92 the latching lug 170 with the latching claw portion 172 for latching the base plate base 108, if the base plate base 108 is latched by the latching claw portion 172 of the latching lug 170 after the extended portion 158 of the switch base plate 104 has been fitted into the fitting insertion hole 164 of the support bracket 162, the body unit 102 may be fixed to the lower casing 92. Therefore, the operation of fixing the body unit 102 of the buckle switch 100 to the lower casing 92 (body casing 12) may be made simple.

It is to be noted that in the present exemplary embodiment, explanation has only been given of application of the switch device according to the present invention to a buckle switch, however, switch devices configured according to the present invention are applicable to switch devices other than buckle devices, and may be applied to the switch devices in which a sliding member is supported by a switch base plate so as to be able to slide, and a switching operation is carried out according to the position of the sliding member along the sliding direction. By so applying the configuration according to the present invention, damage to the contact member disposed on the sliding member during assembly of the sliding member to the switch base plate may be effectively prevented.

What is claimed is:

1. A switch device, comprising:

a switch base plate that includes a sliding surface on one side thereof, and has conducting patterns of a predetermined shape provided on the sliding surface;

a sliding member that is provided with a first claw portion and a second claw portion, the sliding member being latched at one end portion and the other end portion in a width direction of the switch base plate by the first claw portion and the second claw portion, respectively, and the sliding member also being supported by the switch base plate so as to be slidable in a sliding direction that is orthogonal to the width direction of the switch base plate;

a contact member that is formed from a flexible conductive material and is disposed in a position opposing a sliding surface of the sliding member, the contact member being deformed by bending by a pressing force from the sliding surface in a state in which the switch base plate is latched by the first claw portion and the second claw portion, and the contact member is pressed against the sliding surface by a restorative force from the bending deformation;

an extended portion that is formed at a leading end portion of the switch base plate, where one end side in a width direction of the leading end portion of the switch base plate is caused to partially extend further in the sliding direction than the other end side in the width direction, the extended portion also configured to be latched by the first claw portion; and a cut-out portion that is formed at the leading end portion of the switch base plate and causes the leading end portion of the switch base plate to be in a state of non contact with the second claw portion when the extended portion is in a state of being latched by the first claw portion.

2. The switch device according to claim 1, further comprising:

a body casing;

a base plate base that is connected and fixed to a base end side of the switch base plate;

a fitting insertion hole that is provided at the body casing, into which the extended portion is insertable along the sliding direction; and a latching portion that is provided at the body casing and that, when the extended portion is in a state of being fitted into the fitting insertion hole, latches the base plate base and fixes the base plate base and the switch base plate to the body casing.

3. A switch device assembly method for assembling the switch device according to claim 1, the method comprising:

a first process of latching the extended portion with the first claw portion;

a second process of, while the leading end portion of the switch base plate is in a state of non contact with the second claw portion due to the cut-out portion, swinging the switch base plate, with the first claw portion as a center, from a position in which the switch base plate is separated from the contact member to a position in which the contact member is deformed by bending due to the sliding surface; and a third process of sliding the switch base plate along the sliding direction relative to the sliding member, and latching the base end side of the extended portion and the cut-out portion of the switch base plate with the first claw portion and second claw portion.

4. A switch device assembly method for assembling the switch device according to claim 2, the method comprising:

a first process of latching the extended portion with the first claw portion;

a second process of, while the leading end portion of the switch base plate is in a state of non contact with the second claw portion due to the cut-out portion, swinging the switch base plate, with the first claw portion as a center, from a position in which the switch base plate is separated from the contact member to a position in which the contact member is deformed by bending due to the sliding surface; and a third process of sliding the switch base plate along the sliding direction relative to the sliding member, and latching the base end side of the extended portion and the cut-out portion of the switch base plate with the first claw portion and second claw portion.

5. The switch device assembly method of claim 3, the method further comprising:

a fourth process of inserting the extended portion into the fitting insertion hole along the sliding direction after the third process is completed; and a fifth process of fixing the base plate base and the switch base plate to the body casing by latching the base plate base to the latching portion in a state in which the extended portion is fitted into the fitting insertion hole.

6. The switch device assembly method of claim 4, the method further comprising:

a fourth process of inserting the extended portion into the fitting insertion hole by sliding along the sliding direction after the third process is completed; and a fifth process of fixing the base plate base and the switch base plate to the body casing by latching the base plate base to the latching portion in a state in which the extended portion is fitted into the fitting insertion hole.

7. The switch device of claim 2, further comprising a latching rib that is formed at one end face in the thickness direction of the base plate base, and a latching claw portion that is disposed on the latching portion with a cross-section having a sloping shape, the base plate base and the switch base plate being fixed to the body casing by latching between the latching rib and the latching claw portion.

8. The switch device of claim 2, further comprising a base abutment portion that is provided at the body casing so as to face the latching portion, and that abuts the other end face in the thickness direction of the base plate base.

* * * * *